US009701043B2

(12) United States Patent
Fujita et al.

(10) Patent No.: US 9,701,043 B2
(45) Date of Patent: Jul. 11, 2017

(54) DICING BLADE

(71) Applicants: Tokyo Seimitsu Co., Ltd., Hachioji-Shi, Tokyo (JP); Shin-Nihon Tech Inc., Osaka-Shi, Osaka (JP); Junji Watanabe, Sakai-shi, Osaka (JP)

(72) Inventors: Takashi Fujita, Hachioji (JP); Yasuo Izumi, Osaka (JP); Junji Watanabe, Sakai (JP)

(73) Assignees: Tokyo Seimitsu Co., Ltd., Hachioji-Shi, Tokyo (JP); Shin-Nihon Tech Inc., Osaka-Shi, Osaka (JP)

( * ) Notice: Subject to any disclaimer, the term of this patent is extended or adjusted under 35 U.S.C. 154(b) by 0 days.

(21) Appl. No.: 14/397,040

(22) PCT Filed: Apr. 24, 2013

(86) PCT No.: PCT/JP2013/061998
§ 371 (c)(1),
(2) Date: Oct. 24, 2014

(87) PCT Pub. No.: WO2013/161849
PCT Pub. Date: Oct. 31, 2013

(65) Prior Publication Data

US 2015/0107572 A1 Apr. 23, 2015

(30) Foreign Application Priority Data

Apr. 24, 2012 (JP) ..... 2012-099027

(51) Int. Cl.
*B24B 27/06* (2006.01)
*B24D 3/00* (2006.01)
(Continued)

(52) U.S. Cl.
CPC ..... *B28D 5/022* (2013.01); *B24B 27/06* (2013.01); *B24D 5/12* (2013.01); *B28D 1/121* (2013.01)

(58) Field of Classification Search
CPC .. B24B 27/06; B24D 3/00; B24D 3/06; B24D 5/12
(Continued)

(56) References Cited

U.S. PATENT DOCUMENTS 3,574,580 A 4/1971 Stromberg et al.
3,912,500 A 10/1975 Vereschagin et al.
(Continued)

FOREIGN PATENT DOCUMENTS

CN 101870008 A 10/2010
JP 61-104045 A 5/1986
(Continued)

OTHER PUBLICATIONS

May 15, 2015—(KR) Notice of Office Action—App 10-2014-7032483.
(Continued)

*Primary Examiner* — Robert Rose
(74) *Attorney, Agent, or Firm* — Banner & Witcoff, Ltd.

(57) ABSTRACT

An object of the present invention is to provide a dicing blade which does not cause cracking and breaking even in a workpiece formed from a brittle material, and can stably perform cutting process in a ductile mode on the workpiece with high precision. A dicing blade 26 which performs the cutting process on the workpiece is integrally formed of a diamond sintered body 80 which is formed by sintering diamond abrasive grains 82 so as to have a discoid shape, and a content of the diamond abrasive grains 82 of the diamond sintered body 80 is 80 vol % or more. It is preferable that recessed parts which are formed on a surface
(Continued)

of the diamond sintered body 80 are continuously provided in an outer circumferential part of the dicing blade 26 along a circumferential direction.

13 Claims, 17 Drawing Sheets

(51) Int. Cl.
*B28D 5/02* (2006.01)
*B24D 5/12* (2006.01)
*B28D 1/12* (2006.01)

(58) Field of Classification Search
USPC ..... 451/541; 125/13.01, 15
See application file for complete search history.

(56) References Cited

U.S. PATENT DOCUMENTS

| | | | |
|---|---|---|---|
| 4,151,686 | A | 5/1979 | Lee et al. |
| 4,180,048 | A | 12/1979 | Regan |
| 4,636,253 | A | 1/1987 | Nakai et al. |
| 4,874,398 | A | 10/1989 | Ringwood |
| 5,010,043 | A | 4/1991 | Ringwood |
| 5,479,911 | A | 1/1996 | Levinson et al. |
| 5,778,751 | A | 7/1998 | Tsuchishima et al. |
| 6,056,795 | A * | 5/2000 | Ramanath et al. ..... 51/309 |
| 6,200,208 | B1 * | 3/2001 | Andrews et al. ..... 451/548 |
| 6,432,150 | B1 | 8/2002 | Levashov et al. |
| 6,660,996 | B1 | 12/2003 | Adkins et al. |
| 7,762,872 | B2 | 7/2010 | Sung |
| 7,959,841 | B2 | 6/2011 | Zhao |
| 8,192,256 | B2 | 6/2012 | Andrews et al. |
| 8,206,474 | B2 | 6/2012 | Tank et al. |
| 9,316,059 | B1 | 4/2016 | Topham et al. |
| 2002/0168929 | A1 | 11/2002 | Fujioka |
| 2003/0126800 | A1 | 7/2003 | Seth et al. |
| 2003/0159555 | A1 | 8/2003 | Perry |
| 2004/0112360 | A1 | 6/2004 | Boucher et al. |
| 2005/0210755 | A1 | 9/2005 | Cho et al. |
| 2006/0118097 | A1 | 6/2006 | Ishikawa |
| 2006/0160481 | A1 | 7/2006 | Miyanaga |
| 2007/0023026 | A1 | 2/2007 | Michelle |
| 2008/0251061 | A1 | 10/2008 | Baratta |
| 2009/0011693 | A1 | 1/2009 | Cho |
| 2010/0043302 | A1 | 2/2010 | Tank et al. |
| 2011/0073094 | A1 | 3/2011 | Tselesin et al. |
| 2011/0132954 | A1 | 6/2011 | Tomei et al. |
| 2012/0037429 | A1 | 2/2012 | Davies et al. |
| 2013/0059510 | A1 | 3/2013 | Hong et al. |
| 2014/0080394 | A1 | 3/2014 | Kinoshita |

FOREIGN PATENT DOCUMENTS

| | | | |
|---|---|---|---|
| JP | H05-144937 | A | 6/1993 |
| JP | H0574810 | U | 10/1993 |
| JP | H06-151586 | A | 5/1994 |
| JP | H07-276137 | A | 10/1995 |
| JP | 8-301610 | A | 11/1996 |
| JP | 09254042 | A | 9/1997 |
| JP | 2001-054870 | A | 2/2001 |
| JP | 2001-277136 | A | 10/2001 |
| JP | 2002-192469 | A | 7/2002 |
| JP | 3308246 | B2 | 7/2002 |
| JP | 2002-331464 | A | 11/2002 |
| JP | 2003-282490 | A | 10/2003 |
| JP | 2003-326466 | A | 11/2003 |
| JP | 2005-082414 | A | 3/2005 |
| JP | 2005-129741 | A | 5/2005 |
| JP | 2005-297139 | A | 10/2005 |
| JP | 2006-116683 | A | 5/2006 |
| JP | 2006-253441 | A | 9/2006 |
| JP | 3892204 | B2 | 3/2007 |
| JP | 2009-545463 | A | 12/2009 |
| JP | 2010-005778 | A | 1/2010 |
| JP | 2010-010514 | A | 1/2010 |
| JP | 2010-234597 | A | 10/2010 |
| JP | 4714453 | B2 | 6/2011 |
| JP | 2011-190124 | A | 9/2011 |
| JP | 2012-030992 | A | 2/2012 |
| JP | 2012-106478 | A | 6/2012 |
| KR | 2011-0137773 | A | 12/2011 |
| WO | 2008/004365 | A1 | 1/2008 |
| WO | 2008015629 | A1 | 2/2008 |
| WO | 2009/148073 | A1 | 12/2009 |
| WO | 2010092540 | A2 | 8/2010 |

OTHER PUBLICATIONS

Sep. 4, 2014—(JP) Decision of Rejection—App 2014-505300—Eng Tran.
May 29, 2014—(JP) Notification of Reasons for Rejection—App 2014505300—Eng Tran.
Jul. 30, 2013—International Search Report—Intl App PCT/JP2013/061998.
Nov. 13, 2014—International Preliminary Report on Patentability—Intl App PCT/JP2013/061998.
Dec. 12, 2014—(JP) Notification of Reasons for Rejection—App 2014-236666.
Feb. 24, 2015—(JP) Notification of Reasons for Rejection—App 2015-018699.
Oct. 28, 2014—International Preliminary Report on Patentability—Intl App PCT/JP2013/066501.
Sep. 17, 2013—(WO) International Search Report—Intl App PCT/JP2013/066501.
May 27, 2015—(JP) Notification of Reasons for Rejection—App 2015-096460.
Aug. 24, 2015—(US) Non-Final Office Action—U.S. Appl. No. 14/569,061.
Aug. 10, 2015—(JP) Decision of Rejection—App 2015-096460.
Oct. 22, 2015—(EP) Extended European Search Report—App 13803775.9.
Aug. 31, 2015—(CN) First Office Action—App 201380031514.7.
Dec. 8, 2015—(US) Final Office Action—U.S. Appl. No. 14/569,061.
May 6, 2016—(US) Non-Final Office Action—U.S. Appl. No. 14/569,061.
Sep. 8, 2016—(US) Final Office Action—U.S. Appl. No. 14/569,061.
Mar. 6, 2017—(US) Non-Final Office Action—U.S. Appl. No. 14/569,061.
Mar. 24, 2017—(JP) Notification of Reasons for Rejection—App 2015-112414.

* cited by examiner

IN CASE OF 20 μm

IN CASE OF 50 μm

IN CASE OF 70 μm

IN CASE OF l>h

IN CASE OF l<h

DICING BLADE

TECHNICAL FIELD

The present invention relates to a dicing blade to be used when cutting process such as cutting and grooving is performed on a workpiece such as a wafer having semiconductor devices or electronic parts formed thereon.

BACKGROUND ART

A dicing apparatus which divides a workpiece such as a wafer having semiconductor devices or electronic parts formed thereon into individual chips includes, at least, a dicing blade which is rotated at high speed by a spindle, a worktable which mounts the workpiece thereon, and moving shafts of X, Y, Z and θ for changing relative position of the worktable to the blade, and performs cutting process such as cutting and grooving on the workpiece by the operation of each of these moving shafts.

As the dicing blade used in such a dicing apparatus, various types of blades have been proposed (for instance, see Patent Literatures 1 and 2).

In Patent Literature 1, an electroformed blade is described in which diamond abrasive grains are stuck to an end face of a metallic base material (aluminum flange) with an electroforming method using an electroplating technique, and an alloy of soft metal such as nickel, copper or the like is used as a bonding material.

In Patent Literature 2, a diamond blade is described which is formed of a substrate formed of a plurality of diamond layers, by sequentially stacking different diamond layers that have different hardnesses from one another with a chemical vapor deposition (CVD) method.

CITATION LIST

Patent Literature

{PTL 1} Japanese Patent Application Laid-Open No. 2005-129741

{PTL 2} Japanese Patent Application Laid-Open No. 2010-234597

SUMMARY OF INVENTION

Technical Problem

Meanwhile, in recent years, requirements of the miniaturization and high integration for a semiconductor package have increased, and semiconductor chips have been made thinner and thinner. Along with the tendency, an extremely thin workpiece having a thickness of 100 μm or less, for instance, has been required. Such an extremely thin workpiece is extremely easily broken, and accordingly, when the extremely thin workpiece is diced, a groove width of a cutting groove which is formed by the dicing blade needs to be as thin as possible. When the workpiece having a thickness of approximately 100 μm, for instance, is subjected to cutting process, the edge thickness of the dicing blade needs to be made smaller than the thickness of the workpiece, and needs to be at least 100 μm or less. If the workpiece is subjected to cutting process by a dicing blade having an edge thickness larger than the thickness of the workpiece, the workpiece is occasionally broken before being cut. Owing to this, when the workpiece having a thickness of, for instance, approximately 50 μm is subjected to grooving process of forming a groove having a depth of approximately 30 μm, the width of the groove naturally needs to be set at 30 μm or less, and the edge thickness of the dicing blade needs to be controlled to 30 μm or less, accordingly.

However, because conventional dicing blades have the following technical problems, it is impossible to stably perform cutting process on an extremely thin workpiece with high precision.

In addition, as for a brittle material, it is difficult to avoid the occurrence of cracking which causes breaking. Materials having ductility such as copper, aluminum, an organic film and a resin are not broken, but have properties of easily forming a burr, so that it is difficult to avoid the occurrence of the burr of the materials.

(Problem of Crack Caused by Non-Adjustable Projection)

Firstly, an electroformed blade described in Patent Literature 1 shows the state in which diamond abrasive grains 92 are scattered in a bonding material (metal bond) 94, and the diamond abrasive grains 92 each having a sharp tip part project on the surface, as is shown in FIG. 19. At this time, the position of projections and the amount of projections of the diamond abrasive grains 92 are both random, and it is theoretically difficult to control the projections of the abrasive grains with high precision. For this reason, the cut depth in one unit of process cannot be controlled with high precision. When the cutting process is performed on the extremely thin workpiece having a thickness of 100 μm or less, in particular, a crack occurs due to a certain amount or more of cut, and the tip part of the diamond abrasive grains occasionally give a fatal cut to the workpiece. As a result, there is a problem that the cracks are combined with each other and thereby chipping and a chip occur in a greater or less degree.

The reason why such a problem occurs is a surface morphology of the electroformed blade. Specifically, as is shown in FIG. 19, the diamond abrasive grains 92 are bonded by a bonding material 94 in the electroformed blade, but as for the surface morphology, the diamond abrasive grains 92 exist in a form of being scattered in the bonding material 94. Because of this, the electroformed blade shows the state in which a reference plane 98 which is an overall average height position exists in the vicinity of the surface of the bonding material 94, and the diamond abrasive grains 92 project from the reference plane 98. When the dicing process is progressed in this state, not the diamond abrasive grains 92 but the surface portion of the bonding material 94 decreases which combines the diamond abrasive grains 92 with each other, and the amount of projections of the diamond abrasive grains 92 further increases. For these reasons, as has been described above, it is difficult to control the position of projections and the amount of projections of the diamond abrasive grains 92 with high precision.

In the case of the electroformed blade, in particular, as there is a term of a spontaneous edge generation, the electroformed blade functions in a mode in which the diamond abrasive grains 92 which have been worn on the way of the cutting process fall off as it is, and new diamond abrasive grains 92 that exist under the diamond abrasive grains having fallen off subsequently work. However, if such falling off of the diamond abrasive grains 92 is accepted, the diamond abrasive grains 92 having fallen off enter between the blade and the workpiece, and consequently promote a crack.

(Problem of Difficulty in being Sharpened)

In addition, in the case of the electroformed blade, even if the tip part of the blade is intended to be thinned and sharpened by a machining process, there is a limit to an operation of sharpening the tip part of the blade, because the diamond abrasive grains sparsely exist and fall off from the surface along with the process, even if it is intended to machine the blade so as to make it uniformly thin or have a taper.

In other words, in order to manufacture a thin blade, a substrate on which a uniform and thin plating film is formed is manufactured in the plating by an electrodeposition method, and the plating film is removed from the substrate to be formed into a blade. However, it is difficult to shape the blade having been formed by a machining so as to be thin afterward.

(Problem of Heat Accumulation Originating in Poor Thermal Conductance)

In addition, the electroformed blade has poor thermal conductance, has a tendency of easily accumulating heat in itself due to heat generation caused by frictional resistance with the side face of a groove, when performing cutting process, and also has a possibility of causing the warpage of itself.

When the electroformed blade is manufactured by using nickel as a bonding material, the thermal conductivity of nickel is only approximately 92 W/m·K, as is shown in Table 1. In addition, even when copper is used as the bonding material, the thermal conductivity of the copper is only approximately 398 W/m·K. Thus, when the thermal conductance of the blade is poor, the heat tends to be easily accumulated in the blade, the blade is warped, and the diamond is occasionally converted into graphite by the heat generated during the work. Accordingly, the blade performs a machining while being watered and cooled in many cases. Incidentally, the thermal conductivity of the diamond is 2,100 W/m·K, and has extremely higher thermal conductivity than those of nickel and copper.

TABLE 1

| | Specific gravity | Coefficient of thermal expansion [$\times 10^{-6}$/K] | Thermal conductivity [W/m · k] | Vickers hardness Hv |
|---|---|---|---|---|
| Ni | 8.9 | 13 | 92 | 638 |
| Cu | 8.96 | 16.7 | 398 | 369 |
| Diamond | 3.52 | 3.1 | 2100 | 8000-12000 |

(Problem that Cutting Edge Cannot be Formed at Arbitrary Even Intervals)

On the other hand, the diamond blade described in Patent Literature 2 has the following problems.

Firstly, the above described diamond blade is formed with the CVD method, and accordingly is formed into a blade which is formed of an extremely dense film. But as a result, the surface of the diamond blade becomes almost planate, and a recessed shape for arbitrarily giving a cut or a pocket for removing swarf cannot be formed in the surface. In addition, even if fine convexoconcaves are consequently formed, the size of the grain boundary cannot be arbitrarily set before the film is formed. Accordingly, a pitch and the like of the convexoconcaves cannot be arbitrarily designed.

(Problem of Bimetal Effect in the Case of Multilayer)

In addition, when diamond layers having different compositions are formed by stacking, thermal expansion tends to easily change according to the composition. Because of this, when the heat is generated during the dicing process, a thermal stress occurs between each of the diamond layers, and there is a possibility that the blade cannot keep its circularity and flatness. At this time, in some cases, the warpage may occur. When the blade becomes thin, in particular, the influence becomes more remarkable.

(Problem of Run-Out Accuracy in Manufacture of Blade by CVD Film Formation)

In addition, when the diamond blade is manufactured with the CVD method, the thickness distribution of the edge of the blade is determined by the thickness distribution of the formed film. When there is waviness in the thickness distribution of the formed film, in particular, the waviness cannot be removed. Specifically, even if the waviness is intended to be removed by a machining process, cracks or the like result in occurring, and it is difficult to form a thin blade. Accordingly, it is theoretically difficult to fit and mount the reference surface of the blade to and on the reference surface of a highly-precise spindle flange having no run-out, and to enhance the run-out accuracy.

(Securement of Flatness by Joining Different Types of Materials)

In addition, in order to thin the groove width of the groove cut by the blade, the outer circumferential part (tip part) of the blade is preferably as thin as possible, but a portion which abuts on the flange needs to have such a degree of thickness as not to cause the warpage, in order to keep a flat surface that becomes a highly-precise reference. However, if the blade is manufactured to have such portions with different thicknesses, when the blade is manufactured to be an integrated object, a method using film formation cannot be substantially applicable because the blade cannot be substantially manufactured as the integrated object by the method. However, when different types of materials are joined to each other for the purpose, the joined material is deformed due to the thermal stress, and results in disturbing of the circularity and the flatness. Accordingly, the joined material cannot achieve a process in a ductile mode as in the present invention, which will be described later. Here, when a grinding or cutting process is performed, the case is referred to as a process in a ductile mode, where the workpiece is worked in the state in which spiral and streamlined chips are generated.

In addition, a structure in which high-hardness diamond chips are embedded in the outer circumference of the blade resists securing the flatness of the whole blade due to a bimetal effect, because the diamond portion and the substrate portion have different thermal expansions and thermal conductivities. Besides, it results in an aggravation of the flatness also due to the thermal stress because when the chips are arranged in a circumferential shape, the temperature distribution does not become axisymmetrical and ordered.

In addition, in order to perform the dicing in the ductile mode which is crack-free, a thin blade which is 0.1 mm or less needs to be used, and the groove needs to be formed in an extremely local region or the cutting width needs to be limited. However, such a thin blade cannot be formed with the structure in which the diamond chips and the base material are bonded to each other. It is difficult to secure the continuous flatness of the diamond chip portion and the other base material portion.

Furthermore, the diamond chip portion has extremely high hardness, but the base material portion occasionally absorbs an impact which the diamond chip receives, due to an elastic effect of the metal portion of the base material. When the machining is performed in the ductile mode, it is necessary to continuously form an extremely fine cut. However, when the base material has absorbed such an impact, the process in the ductile mode under the extremely fine cut cannot be performed.

From the above description, the blade embedded with the diamond chip has a problem, in consideration of the points of the thermal conduction, the flatness of the shape, the continuity of the flat surface and a property of exerting a locally effective shearing force on the workpiece without absorbing the impact caused by the process.

(In Film-Forming Method, Blade Warpage Occurs Because Stress Distribution Varies Depending on Film Deposition Direction.)

In addition, in the above described diamond blade, a compressive stress is formed in the film formed of the diamond layers which have been film-formed with the CVD method, and accordingly a degree of exerted stress varies as the film is deposited. Because of this, when the film is removed and is formed into the blade in the final stage, a degree of exerted compressive stress is different between both left and right surfaces, and as a result, the blade is warped. Even though such a warpage of the blade is intended to be corrected, there is no means to correct the warpage, and there is a concern that a yield is aggravated by the stress in the film.

(Problem of Scribing Process)

In addition, even if the blade is manufactured with high precision, and an ideal blade has been manufactured of which the tip part is sharp and a planer state is not changed even by the heat in the cutting process, a method for using the blade also becomes important as another problem, though the problem is not a problem of the blade itself. In particular, in the case of the scribing process or the like, which makes the blade itself press the workpiece in a vertical direction, form a crack and progressively cut, because the process clearly uses a brittle fracture, the process in the ductile mode as in the present invention which will be described later cannot be performed.

In the scribing process, a relative velocity is set at zero so that the blade does not slide on the workpiece. In the scribing process, the blade needs to be freely rotated in order to exert a vertical stress on the material, and a blade structure has a form of pressing a bearing or a bearing portion in the blade vertically in a downward direction.

A blade holding portion for sliding the blade along the workpiece, and a blade portion which rotates while coming in contact with the workpiece must not be completely fixed. The blade is not connected directly to the motor without having freeplay.

Under the above circumstances, in a conventional blade structure for the scribing process, a sliding portion between the shaft and the bearing portion becomes important.

Incidentally, the present application is not proposed for the scribing process, and accordingly has a structure in which the motor and the blade are connected directly to each other. A relationship of the shaft and the bearing does not exist, and the motor and the blade are incorporated in a coaxial structure by fitting with high precision.

For this purpose, the face mating between the end face of the blade and the end face of the flange which is connected directly to the motor becomes important. Specifically, in the blade for dicing, a reference plane becomes necessary for being mated with the end face of the flange.

(To Perform Cutting Workpiece while Keeping Certain Cut Depth)

In addition, there is also the case where a removal volume largely changes as the blade cuts the workpiece, the volume itself to be removed by one cutting edge changes. As a result, a predetermined critical cut depth for one cutting edge performing removal cannot be controlled, and consequently, a cutting resistance largely changes during the cutting process, which causes unbalance and consequently causes a crack in the workpiece material. In such a case as well, the phenomenon becomes a cause of inducing the brittle fracture, and the process in the ductile mode cannot be achieved. Specifically, in order that one cutting edge microscopically keeps a certain cut depth with respect to the workpiece, a certain cut needs to be given also to the workpiece, and a steady state needs to be secured during the work.

In addition, when the workpiece is not a tabular sample, there is a case where the workpiece cannot be adequately fixed. When a cylindrical-shaped workpiece is cut intact, for instance, the workpiece moves, the cut is not constant, and besides, there is even the case where the workpiece vibrates due to the cut.

Next, on the other hand, in recent years, there is also a material in which a ductile material and a brittle material are mixed, such as a Cu/Low-k material (material in which copper material and material having low dielectric constant are mixed). The workpiece such as the brittle material like the Low-k material needs to be worked in a deformation region of the material so that the brittle fracture does not occur therein. On the other hand, Cu is a ductile material, and accordingly is not broken. However, such a material tends to be extremely extended, while being not broken. Such a material having high ductility clings to the blade, and also causes a large burr in a portion from which the blade is extracted. In addition, in a circular blade, a mustache-like burr is formed in the upper part in many cases.

In addition, there is the case where the material having the high ductility is dragged by the blade even after having been cut. In the case, the material has a problem of clinging to the blade. When the material clings to the blade, such problems arise that the clogging of the blade early occurs, the cutting edge portion of the blade is covered with the workpiece material and a grinding performance is remarkably lowered.

The present invention is designed with respect to such circumstances and aims to provide a dicing blade which does not cause a crack and breaking even in a workpiece formed from a brittle material, and can stably perform cutting process in a ductile mode on the workpiece with high precision; while prohibiting occurrence of a burr in a ductile material to suppress the progression of the clogging of the blade.

Solution to Problem

In order to achieve the above described object, a dicing blade according to one aspect of the present invention is a rotary dicing blade mounted on a spindle and relatively slides on a flat tabular workpiece at a certain cut depth to perform cutting or grooving process on the workpiece, wherein the dicing blade is integrally composed of a diamond sintered body which is formed by sintering diamond abrasive grains and have a discoid shape, and the diamond sintered body has a content of the diamond abrasive grains of 80 vol % or more.

In the present invention, it is preferable that, in an outer circumferential part of the dicing blade, fine cutting edges which are composed of recessed parts that are formed on a surface of the diamond sintered body are provided along a circumferential direction.

The dicing blade is formed of the diamond sintered body, and accordingly is completely different from a conventional material formed by diamond electrodeposition, the conventional material which is formed by an electrodeposition technique using a bonding material softer than diamond.

In the case of the conventional electrodeposition diamond, the bonding material retreats compared to the diamond. Accordingly, the diamond projects, and as a result, the projection of the diamond abrasive grains from an average level line has been large. As a result, the cut depth becomes excessive in the abrasive grain portion at which an amount of projection is large, and results in excess of the critical cut depth inherent to the material and causing a crack.

In contrast to this, in the case of the present application, the diamond blade is formed mostly of diamond, and each recessed portion surrounded by the diamond becomes a cutting edge. Because of this, the abrasive grains of which the peripheries retreat and which project are not formed. As a result, the excessive cut depth is not formed, and the recessed part functions as a cutting edge. The reference surface is a flat surface and is a diamond face, and the recessed portions randomly exist therein. Accordingly, basically, the recessed portions perform the machining as the cutting edge.

Thus, the diamond abrasive grains dominantly exist in the whole, and sintering aids which are scattered and left exist between the diamond abrasive grains. Thereby, each cutting edge which is formed in the blade is a recessed cutting edge that is formed among the diamond abrasive grains. In addition, the content of the diamond abrasive grains at this time will be described later, but only when the content of the diamond abrasive grains is 80% or more, the empty portion functions as the cutting edge. If the content decreases, a form in which the recessed portions are formed in the outer brim that is formed of the diamond abrasive grains is not obtained, instead, convex portions and concave portions almost equally exist or convex portions become dominant, and relatively projecting portions are formed. Consequently, the projecting portions do not become such cutting edges that form a cut having a stable cut depth of certain (fixed) amount or less on the workpiece without causing a fatal crack in the workpiece.

In addition, the blade according to the present application is formed of a sintered diamond, which becomes a great feature of the blade according to the present application. The sintered diamond is manufactured by the steps of spreading diamonds having a previously uniformized particle size, adding a trace amount of sintering aids thereto and subjecting them to a high temperature and a high pressure. The sintering aids diffuse into the diamond abrasive grains, and as a result, the diamonds are strongly combined with one another.

In the electrodeposition blade and the electroformed blade, the diamonds are not combined with each other. The method of fixing the diamond abrasive grains is a method of fixing the scattered diamonds with a surrounding metal.

In the case of the sintering process, the sintering aids diffuse into the diamonds and thereby strongly combine the diamond particles to each other. The blade can utilize the characteristics of the diamond by bonding the diamond particles to each other. As the content of the diamond increases, the blade can utilize the physical properties almost close to those of the diamond, in the rigidity, the harness and the thermal conduction of the diamond. This is because the diamonds are bonded to each other.

The blade is manufactured by being fired under a high temperature and a high pressure compared to other manufacturing methods such as the electroformed blade, and thereby the diamonds are combined with each other. For instance, COMPAX DIAMOND (trademark) made by General Electric Company corresponds to this sintered diamond. In the COMPAX DIAMOND, fine particles formed of single crystals are bonded to each other by the sintering aids.

As for the content of the diamond, a natural diamond, an artificial diamond and the like naturally have a large content of diamond, and exist as a strong diamond. Such a single crystal diamond tends to easily cause cracking along a cleavage plane, when falling off. In the case where the whole blade is formed of the single crystal diamond, for instance, if there is the cleavage plane in a certain direction, the blade occasionally is broken into two pieces in the cleavage plane, even though having been molded into a discoid shape. Even when the diamond is worn by the progression of the process, there is also a problem that the wear occurs dependently on a face orientation along the cleavage plane.

In the case of the single crystal diamond, it is impossible to strictly control the unit amount of diamond when the diamond is worn during a wearing process in the material.

On the other hand, similarly, a member such as DLC (diamond like carbon) which has been manufactured by being vapor-phase grown by the CVD is also manufactured as a polycrystal body, but the size of the grain boundary cannot be controlled with high precision. Because of this, it cannot be set how uniformly the diamond should be worn when the diamond is worn from the crystal grain boundary, and thus, the unit of the crystal or grain boundary cannot be strictly controlled, by which the crystals wear and fall off due to the process. Therefore, such phenomena can occur in some cases that the member is largely fractured, and an excessive stress is applied to a part of defect and the diamond is largely broken.

On the other hand, PCD (Polycrystalline Diamond) which is obtained by mutually firing fine particles of diamond under a high temperature and a high pressure is manufactured as a polycrystal diamond that is similar to DLC and the like, but has a completely different crystal structure from those of the others. In the PCD obtained by mutually firing the fine particles, the fine particles of the diamond themselves are single crystal bodies, and are complete crystal bodies having extremely high hardness. In the PCD, the single crystals are bonded to each other by the sintering aids which are mixed for combining the single crystals with each other. At this time, the orientations of bonded portions are not completely aligned, and accordingly the crystals do not form the single crystal as a whole, but show a form in which the crystals are bonded as the polycrystal body. Because of this, the crystal orientation dependency does not exist also in the wearing process, and the PCD has a fixed large strength in any direction.

As has been described above, in the case of the PCD, all of the structures are not complete single crystals. Accordingly, the structure is polycrystal, but the PCD is a polycrystal body in such a state that fine single crystals having a uniform size are densely agglomerated.

Due to such a structure, the PCD can keep an initial state with high precision, in the point of controlling the state of a cutting edge in the outer circumference and a pitch unit of the cutting edge in the outer circumference, in the wearing process in the work. In the process that the PCD is worn by dicing, single crystals fall off by a mechanism that the bonding is cut from the grain boundary portion because the portion in which the single crystal and the single crystal are bonded to each other has relatively weak hardness and strength, rather than a mechanism that the single crystals themselves are broken.

In the PCD, the single crystal is worn along the crystal grain boundary existing between the single crystals, and accordingly when the cutting edges are formed, the cutting edges are formed naturally at evenly set intervals. Thus formed convexoconcaves all become the cutting edge. In addition, the cutting edges of the convexoconcaves due to the grain boundaries among the particles also exist among the cutting edges due to the natural convexoconcaves existing at even intervals. All of these cutting edges are formed of the diamond, and accordingly exist as cutting edges.

The blade according to the present application has a structure by the PCD and has a discoid shape; and particularly shows the effect due to the combination. There exist cutting edges in the disc-shaped outer circumference, and the cutting edges reach a working point in a form of sequentially machining on the working point. The cutting edge is not always on the working point during the process, but contributes to the process only by an arc of an extremely local portion while rotating. Accordingly, the machining and the cooling are repeated, and thereby the tip part is not excessively overheated. As a result, the diamond does not cause a thermochemical reaction, and stably contributes to the process.

Next, the formation of the cutting edge at even intervals becomes an indispensable factor for ductile mode dicing that is the subject of the present application, which will be described later. Specifically, in the ductile mode dicing, a cut depth that one cutting edge gives to the material becomes important, as will be described later, and in addition, "interval between cutting edges in outer circumferential part of blade" becomes essential factor associated with the cut depth which one cutting edge makes on the workpiece. In this regard, a relationship between the critical cut depth which one edge makes on the workpiece and the interval between the cutting edges will be described later, but in order to specify the critical cutting depth of one edge, it becomes indispensable to stably set the interval between the cutting edges. In order that this interval between the cutting edges is set with high precision, the PCD becomes suitable in which the single crystal abrasive grains having a uniform particle size are bonded to each other by sintering.

In addition, in "formation of cutting edge at even intervals" in the present application, a difference between the arrangement of the diamond abrasive grains in the PCD material according to the present application and a conventional blade in which the diamond abrasive grains are arranged in other general examples will be complementarily described below.

In the electroformed blade, the content of the abrasive grains is small. Also in Japanese Patent Application Laid-Open No. 2010-005778 and the like, the content of the diamond abrasive grains occupying in the abrasive grain layer is approximately 10%. Therefore, the content of the abrasive grains is scarcely set so as to exceed 70%. Because of this, each of the abrasive grains sparsely exists. The abrasive grains are uniformly arranged to some extent, but in order to secure sufficient projection of one abrasive grain, the interval between the abrasive grains is also large.

In Japanese Patent No. 3308246, a dicing blade for cutting a rare-earth magnet is described, and is formed of a composite sintered body of diamond and/or CBN (Cubic Boron Nitride). The content of the diamond or the CBN is determined to be 1 to 70 VOL %, and is determined more preferably to be 5 to 50%. The patent describes that when the content of the diamond exceeds 70%, the dicing blade becomes weak to the impact and is easily broken, though having no problem in warpage and bending.

Japanese Patent No. 4714453 also discloses a tool for performing a cutting or grooving process on a composite material of ceramics, metal, glass and the like. The patent describes that the tool which is manufactured by firing the diamond contains 3.5 to 60 VOL % of the abrasive grains in the fired body. The patent describes that a technical subject here is that the bonding material has a high power of holding the abrasive grains even though having high elasticity and high hardness, and that if the blade has the described structured, a sufficient projection of the abrasive grains can be always kept. It is described that the blade can perform a high-speed machining while effectively keeping spontaneous edge generation, by sufficiently assuring "projection of abrasive grains".

Thus, when conventional examples are considered, the electroformed blade and the blade of the diamond sintered body do not spread diamonds so that no gap is formed among the abrasive grains. In addition, there does not exist a way of thinking of using the gaps among the spread abrasive grains as the cutting edge. In the present application, the critical cut depth which one cutting edge gives to the workpiece becomes important and will be described later by expressions, in order that the workpiece is worked in the ductile mode, and the interval between the cutting edges becomes important, in order that the cut depth is kept at a fixed value or less. In addition, the blade according to the present application does not form cutting edges due to the abrasive grains which are large, are isolated and project, but forms cutting edges at even intervals by spreading the diamonds and using the recessed portions among the spread diamonds.

FIGS. 20A and 20B schematically show a state of the interval between abrasive grains, according to the content of diamond abrasive grains. In order to form the cutting edges which do not give an excessive cut to the workpiece, at a fixed interval between abrasive grains, it becomes necessary that the diamonds are closely spread, a part of the abrasive grains is continuously removed, and the resultant surface is roughened. For this purpose, the content of the diamond abrasive grains needs to be at least 70% or more at the lowest, in order to spread the diamond grains. Moreover, a part of the diamonds must be removed. When the diamond abrasive grains are sintered so that the content becomes 80% or more, the diamond abrasive grains can form a state in which the diamonds are spread so as not to form gaps among the diamonds at least spatially as is shown in FIG. 20A. After that, the blade having the cutting edges at even intervals can be naturally formed by roughening the surface while removing the abrasive grains themselves, in the above state. In addition, all of thus formed convexoconcaves function as the cutting edges.

From the above description, in order to form the cutting edges at even intervals, the blade needs to be formed from a material which is formed by spreading abrasive grains with high density and then firing the grains under a high temperature and a high pressure.

In addition, when the content of the diamond abrasive grains is 70% or less, as is shown in FIG. 20B, it becomes difficult to arbitrarily form cutting edges at even intervals. This is because when the content is 70% or less, a portion in which the diamond abrasive grains are rich and a portion in which the diamond abrasive grains are sparse are inevitably formed, and because in the portion in which the diamond abrasive grains are sparse, the interval between the cutting edges has a possibility of increasing due to the existence of the isolated abrasive grain. When the interval between the cutting edges is large, or when there is a sparse portion and only one diamond abrasive grain largely projects, for instance, the strict amount of the projection cannot be set, and the large diamond abrasive grain gives such a cut depth as to cause a fatal crack to the workpiece.

In Japanese Patent No. 4714453 which has been previously described, in order to achieve an object of performing the machining at high speed under the sufficient projections of the abrasive grains, the content of the diamond abrasive grains is preferably set at 70% or less. However, in the present application, it is an object to perform crack-free dicing in a ductile mode. For this reason, the content of the diamond is preferably 70% or more at the minimum, and ideally desirably is 80% or more, in order to make the recessed portion between the abrasive grains function as the cutting edge, and keep the interval between the cutting edges at a constant interval.

In addition, the blade in this case is not a blade for simply cutting a material with a sharp edge such as a cutter. Specifically, the blade is not a blade which has the tip manufactured into the sharp edge and cuts a material according to a principle as in scissors. The blade needs to remove the workpiece while shaving, and to enter a groove. The blade needs to continuously perform operations of putting the next edge into the material while discharging swarf. Therefore, the tip may not simply be sharp, but needs a fine cutting edge.

In such a structure that the diamonds densely spread, the cutting edge portions are formed at constant interval not only by the grain boundary portions but also by the natural roughness of the outer circumferential portion. Such an interval between the cutting edges will be shown later by an example in which the cutting edge has a specific interval, but it occasionally occurs that the particle size of the diamond and a size of the interval between the cutting edges become completely different.

In the case where the cutting edges have an interval which is different from the particle size of the diamond, the concept for the cutting edge becomes different from that in the usual electroformed blade. Specifically, in the conventional blade, the diamonds are embedded and exist in the bonding material, and accordingly the individual diamonds are independently exist. Therefore, the size of the cutting edge becomes equal to the particle size of the diamond. Specifically, one diamond forms one cutting edge. In such a structure, the unit of the spontaneous edge generation is each of the diamonds, and in other words, corresponds to each of the cutting edges. The unit of the cutting edge is not different from the unit of the spontaneous edge generation. When snagging on the workpiece is needed to some extent, for instance, the cut is needed and accordingly the cutting edge needs to be also enlarged. However, because the spontaneous edge generation occurs due to the falling off of the abrasive grains themselves, the unit of the spontaneous edge generation is also being larger, and the life becomes extremely shorter.

From the above description, in the conventional electroformed blade or the like, the fact that the size of the abrasive grains and the size of the cutting edge become equal, becomes a restriction for keeping the state of the cutting edges.

In contrast to this, in the case of the blade using the sintered diamond of the present application, small diamonds are bonded to each other. Cutting edges larger than the diamond particles are formed in the outer circumferential part of the blade of the sintered diamond which is formed of diamonds bonded to each other. The particle size of the diamond each of which is the abrasive grain constituting the sintered body is as extremely small as approximately 1μ, in comparison with the unit of the cutting edge.

When the blade according to the present invention is used, each of the diamonds falls off along with the work, but it does not occur that the whole cutting edge falls off. In addition, when the diamond falls off, the abrasive grain which forms one cutting edge does not fall off as in the electroformed blade, but a part of the diamonds in the portion in which the diamonds are bonded to each other is missed and fall off.

As a result, in the case of the present application, it does not occur in the process in which the spontaneous edge generation occurs that the diamond exfoliates and falls off due to wearing in a region which is smaller than the size of the cutting edge, and that the size of the cutting edge itself largely changes. The dicing becomes a form of progressing while the diamond extremely finely and partially exfoliates and falls off, in one cutting edge. As a result, the size of the cutting edge itself does not change, and on the other hand, the sharpness of the whole cutting edge is not aggravated by the wearing. The maximum cut depth per one cutting edge is kept within a fixed value while the blade is finely, partially and spontaneously generated. As a result, it becomes possible to continue the process of the ductile mode while keeping the stable sharpness.

In addition, in another way of thinking, when one abrasive grain has fallen off in the case of the conventional bonding material, for instance, in the case of a dresser which is formed by fixing the abrasive grains by electrodeposition using nickel or the like, the fallen off portion becomes a hole, accordingly the cutting edge is lost, and the workability in a portion corresponding to the hole is lost. Because of this, in order to keep the workability, the blade needs to be designed so that the bonding material is quickly worn in order to make the next cutting edge easily project and so that the next abrasive grain projects.

In contrast to this, in the structure of the present application, the portion in which the diamond has been chipped becomes a small recess, the recessed portion also exists as a fine cutting edge which exists in a large cutting edge that is a region surrounded by other diamond abrasive grains, and constitutes fine roughness which functions as a trigger of entering into the workpiece. Specifically, the way of thinking for the spontaneous edge generation in this structure is completely different from that in the conventional structure, in the point that the portion from which the diamond has been missed becomes the next cutting edge as it is.

In addition, in the present invention, the above described diamond sintered body is preferably formed by sintering the above described diamond abrasive grains with the use of the sintering aid formed from a soft metal.

When the sintering aid is formed from the soft metal, the blade becomes electroconductive. When the blade is not electroconductive, it is difficult to accurately estimate the outer diameter of the outer peripheral end part of the blade, and it is difficult to accurately estimate the position of the tip of the blade with respect to the workpiece, in consideration of a mounting error caused by being mounted on a spindle.

Then, an electroconductive blade is used as the blade, and also is designed so as to be brought into conduction with a chuck plate for chucking a planate substrate which becomes reference, and then is brought into conduction with the chuck plate when the electroconductive blade has been brought into contact with the chuck plate. Thereby, a relative height of the blade to the chuck plate can be found.

In addition, in the present invention, the above described recessed parts are preferably each formed of a recessed part which is formed by subjecting the above described diamond sintered body to abrasion treatment or dressing treatment.

In addition, in the present invention, it is preferable that the average particle size of the diamond abrasive grains is 25 μm or less. Here, a cited document of a diamond blade for cutting a rare earth magnet, which is Japanese Patent No. 3308246 and describes a cited conventional example concerning a sintered diamond blade, describes that the content of the diamond is desirably 1 to 70 VOL % and that the average particle size of the diamond is desirably 1 to 100 μm. In addition, the document describes in Example 1 that the average particle size of the diamond is 150 μm. The blade is directed at decreasing bending and warpage and enhancing the wear resistance of a cored bar.

Similarly, according to the blade in Japanese Patent No. 3892204, it is effective for the particle size of the diamond that the average particle size is 10 to 100 μm but the average particle size is more desirably 40 to 100 μm.

Japanese Patent Application Laid-Open No. 2003-326466 describes a blade for dicing ceramics, glass, a resin and metal, and describes that the average particle size is preferably 0.1 μm to 300 μm.

Thus, the conventional blades are described to be suitable when the particle size of the diamond is a comparatively large size.

In the present invention, it is desirable that the average particle size of the diamond abrasive grains is 25 μm or less in association with the content of the diamond.

In the case of 25 μm or more, the ratio of an area is remarkably reduced in which the diamonds are brought into contact with each other, and accordingly though a part of the diamonds are combined by being sintered, most of the diamonds are not combined because of absence of the sintering aid to form spaces.

The blade needs to have such a distance in the thickness direction that two to three fine particles exist in the thickness direction at the minimum, otherwise the blade itself cannot be formed into a strong blade in which each of the abrasive grains are combined with each other. When the blade is formed of fine particles having the size of 25 μm or more, the thickness direction needs to be 50 μm or more at the minimum. However, in the blade having a thickness of thicker than 50 μm in the thickness direction, the maximum cut depth to which one edge cuts down is larger than a Dc value of 0.1 μm, for instance, in SiC, from the linearity of the existing cutting edge. Therefore, there is a possibility that the machining does not finely become process in the ductile mode, and it becomes difficult to perform an ideal process in the ductile mode. Consequently, the possibility of causing a brittle fracture becomes theoretically extremely large. This point will be described in detail later.

Therefore, it is desirable to control the particle size of the diamond to 25 μm or less. However, as for the smallest particle size, the fine particle diamond down to approximately 0.3 to 0.5 μm has been examined under present conditions, but the circumstance is unclear for the ultrafine particle diamond having particle sizes below the sizes.

In addition, in the present invention, it is preferable that the above described outer circumferential part of the dicing blade is formed so as to be thinner than the inside portion of the above described outer circumferential part, and it is more preferable that the thickness of the above described outer circumferential part of the dicing blade is 50 μm or less.

Specifically, the outer circumferential part of the dicing blade means a width of a portion which enters the workpiece. In the case of the ductile mode dicing, the portion which enters the workpiece occasionally breaks the workpiece, when the width of the blade is larger than the thickness of the workpiece. This phenomenon will be described in detail later.

In addition, in the present invention, it is preferable that the dicing blade has a flat surface which becomes a reference, in one side face of the above described dicing blade.

Advantageous Effects of Invention

According to the dicing blade according to one aspect of the present invention, a blade is formed by sintering fine diamond particles. The blade which is formed integrally by using the diamond sintered body is molded into an approximately discoid shape, and a cutting edge is formed on the outer circumferential part.

Firstly, the PCD which is a sintered body of diamond has a thermal conductivity which is different from that of Ni, and has extremely excellent thermal conductivity. The blade rotates at high speed and machines the workpiece, and accordingly the working point (machining point) sequentially changes on the outer circumferential part of the blade. The whole perimeter of the outer circumferential part of the blade contributes to the process, but even when the blade is eccentric to some extent and a part of the blade does not completely contribute to the process, the temperature distribution of the outer circumferential portion becomes uniform at once due to large thermal conduction of the diamond.

In addition, simultaneously with the uniformization in the outer circumferential portion, heat spreads out the whole perimeter of the blade, and a large temperature gradient is not formed in the blade. Furthermore, the blade is formed of the integrated PCD, and has the discoid shape. Accordingly, the temperature becomes uniform in the circumferential direction at once, and the temperature in the whole blade becomes equal.

In addition, in the case of the discoid shape, even when the thermal stress is generated due to the thermal expansion of the whole blade under the same temperature, a shear stress due to an influence of a Poisson ratio is not generated in the cross section of the discoid shape, when the temperature distribution is circularly symmetric, and accordingly the plane shape can be stably kept.

Furthermore, the PCD blade coaxially abuts on and is supported by the flange. The support flange is coaxial with the PCD blade, also is brought into contact with an abutting surface which is circular or ring-shaped and is coaxial with the PCD blade, and is mounted on the abutting surface. The flange is previously adjusted so as to be perpendicular to a direction of a rotation axis of the spindle. The reference surface of the PCD blade is brought into close contact with the flange, thereby the PCD blade rotates perpendicularly to a rotating direction of the spindle, and the run-out can be eliminated.

In addition, the heat escapes from the contacted flange surface in no small way. However, the flange area from which the heat escapes also has a circular or ring-shaped installation surface which is coaxial with the outer circumference of the PCD blade, and thereby the temperature distribution between the machining unit of the outer circumference and a ring-shaped installation surface keeps circular symmetry.

Accordingly, as long as the temperature distribution is circularly symmetric, the shear stress does not occur in the radial direction in the plane due to the influence of the Poisson ratio, and the cutting edge of the outer circumference continues being kept in the same plane. Therefore, similarly, the cutting edge works on the workpiece in a straight line.

Thus, the blade is manufactured from a material having adequate thermal conductivity such as the PCD, besides, the blade has a discoid shape, and furthermore, the abutting surface of the flange that supports the blade has a circular shape or a ring shape which is coaxial with the outer circumference of the blade. As a result of the factors being unified, the flatness of the discoid shape is kept even when the outer circumference during being worked becomes a high-temperature state, and consequently the cutting edge which has been formed on the outer circumference of the blade works on the workpiece in a straight line while the blade rotates. The fact that the cutting edge works in a straight line enables the ductile mode dicing, because of the continuity of the intervals between the cutting edges.

Furthermore, the same cutting edge does not always come in contact with the workpiece, but the cutting edges are sequentially replaced by the rotation of the circular plate of the blade. Thereby, the blade does not always exist under a high-heat environment, but alternately repeats cycles of contributing to the process and being cooled, and accordingly the diamond is not worn by a thermochemical reaction.

In addition, the dicing blade according to the present invention is integrally structured into a discoid shape from the diamond sintered body having the content of the diamond abrasive grains of 80% or more, and accordingly the cut amount of the dicing blade with respect to the workpiece can be controlled with high precision in comparison with the conventional electroformed blade. As a result, the blade also can form cuts even on the workpiece formed of brittle material in a state in which the cut amount by the dicing blade is set to be a critical cut amount of the workpiece or less, thereby can stably perform cutting process in the ductile mode with high precision while preventing cracks and breaks.

DESCRIPTION OF EMBODIMENTS

Preferable embodiments of the dicing blade according to the present invention will be described below with reference to the attached drawings.

Figure 1:
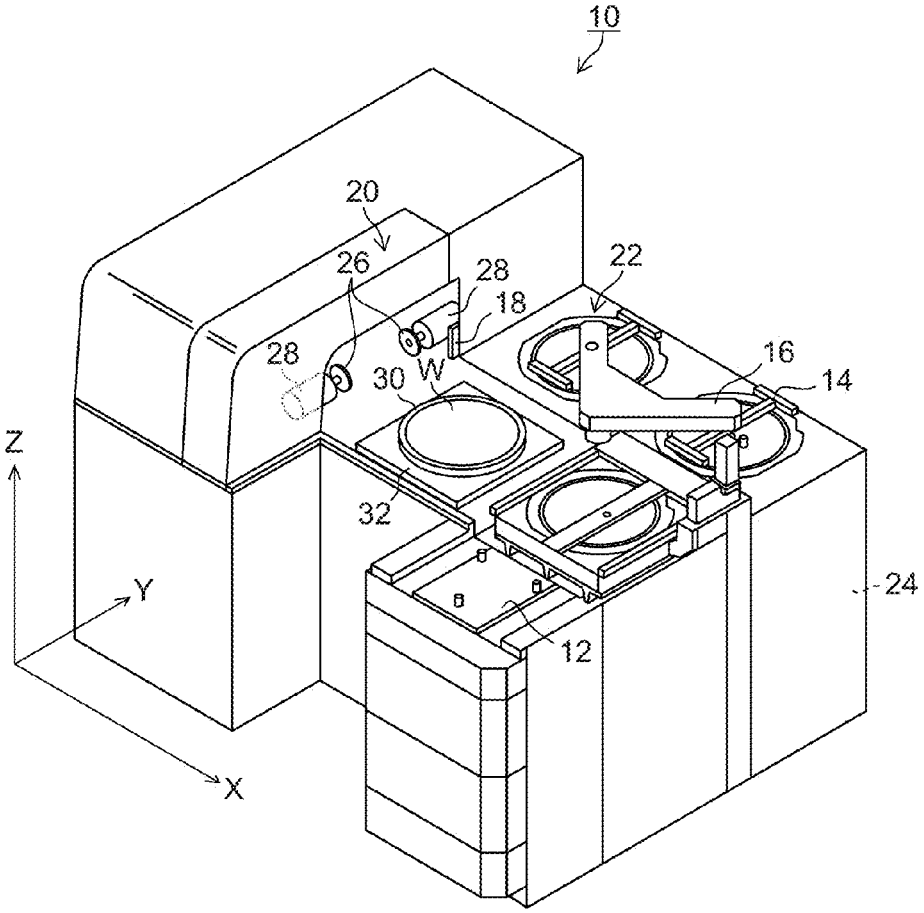
FIG. 1 is a perspective view showing an appearance of a dicing apparatus.

FIG. 1 is a perspective view showing an appearance of a dicing apparatus. As is shown in FIG. 1, the dicing apparatus 10 includes: a load port 12 which delivers a cassette having a plurality of workpieces W accommodated therein, between the dicing apparatus and an external apparatus; transporting means 16 which has an adsorbing portion 14 and transports the workpiece W to each unit of the apparatus; imaging means 18 which takes an image on the surface of the workpiece W; a machining unit 20; a spinner 22 which cleans the workpiece W which has been worked, and dries the cleaned workpiece; and a controller 24 which controls the operation of each unit of the apparatus.

In the machining unit 20, two air-bearing type spindles 28 are arranged so as to face each other, each of which has a dicing blade 26 mounted on the tip and incorporates a high-frequency motor, and each independently perform an operation of index feeding in a Y direction and an operation of cut feeding in a Z direction in the figure, while rotating at high speed at a predetermined rotational speed. In addition, a worktable 30 which absorbs and mounts the workpiece W thereon is structured so as to be capable of rotating around the central axis in the Z direction, and is also structured so as to be fed for grinding in an X direction in the figure by the movement of an X table 32.

The worktable 30 includes a porous chuck (porous body) which absorbs the workpiece W by vacuum while using the negative pressure. The workpiece W mounted on the worktable 30 is held and fixed by the porous chuck (not shown) in the state of being vacuum-absorbed. Thereby, the whole surface of the workpiece W which is a tabular sample is uniformly absorbed by the porous chuck in the state of being straightened into a flat surface. Because of this, the displacement of the workpiece W does not occur, even when a shearing stress has worked on the workpiece W during a dicing process.

Such a workpiece holding method of vacuum-absorbing the whole workpiece leads to an action of the blade that the blade always gives a certain cut depth to the workpiece.

In the case where the workpiece is a sample which is not straightened into a tabular shape, for instance, it is difficult to define the reference surface of the surface of the workpiece. Because of this, it becomes difficult to determine how much degree of cut depth by the blade should be set from the reference surface. If a certain cut depth of the blade with respect to the workpiece cannot be set, the critical cut depth that one cutting edge always stably gives a cut also cannot be set, and it is difficult to perform stable ductile mode dicing.

If the workpiece is straightened into the tabular shape, the reference surface of the surface of the workpiece can be defined, and the cut depth of the blade from the reference surface can be set. Accordingly, the critical cut depth per one cutting edge can be set, and the stable ductile mode dicing is enabled.

Note that the workpiece holding method may not be the vacuum absorption method, and may be a form in which the whole surface is bonded onto a hard substrate. If the face onto which the whole surface has been strongly bonded can be specified as reference surface, even though the substrate is a thin substrate, the stable ductile mode dicing is enabled.

Figure 2:
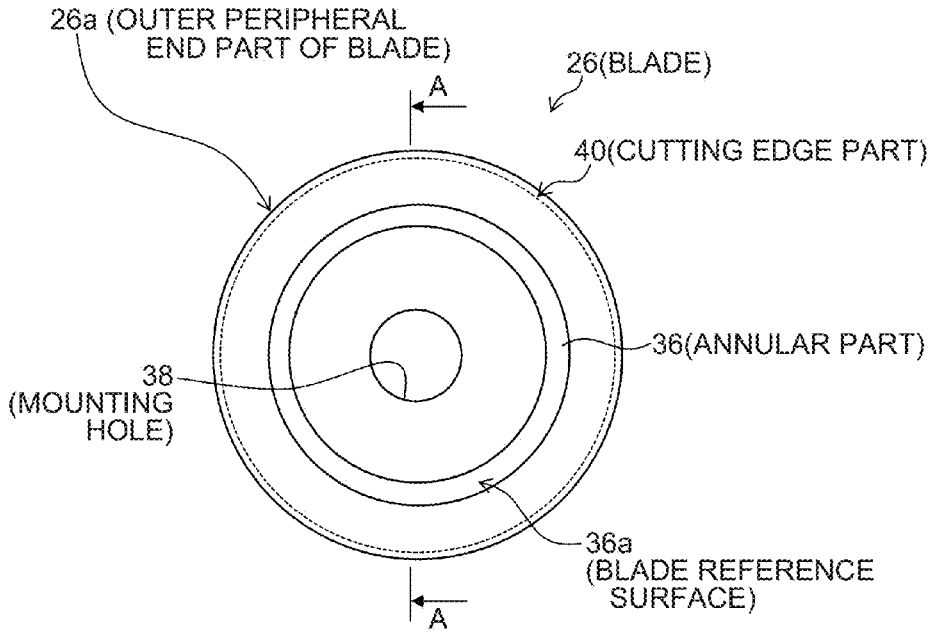
FIG. 2 is a front view of a dicing blade.
Figure 3:
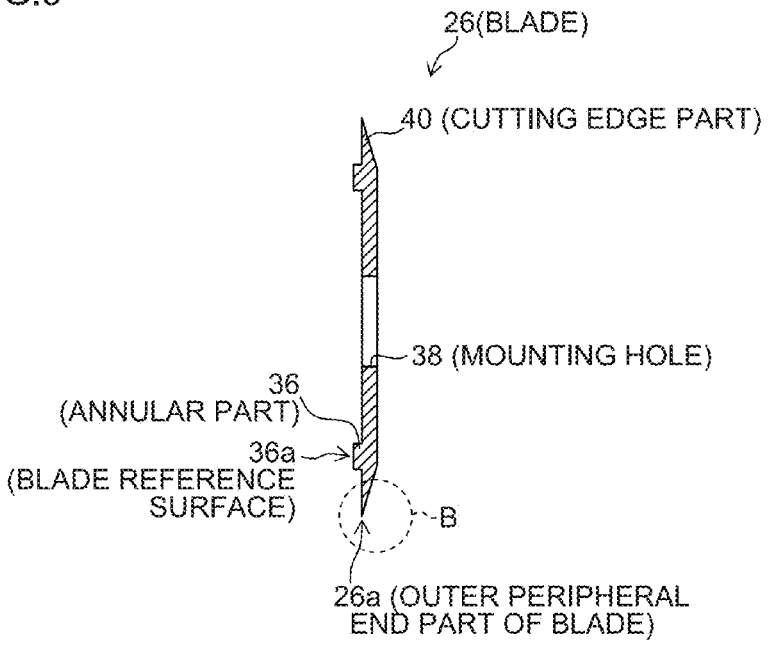
FIG. 3 is a side sectional view showing a cross section taken along the line A-A in FIG. 2.

FIG. 2 is a front view of the dicing blade. FIG. 3 is a side sectional view showing the cross section taken along the line A-A in FIG. 2.

As is shown in FIG. 2 and FIG. 3, the dicing blade (hereinafter referred to simply as "blade") 26 of the present embodiment is a ring-shaped blade, and a mounting hole 38 for being thereby mounted on the spindle 28 of the dicing apparatus 10 is formed in the central part.

Incidentally, the blade 26 is formed of a sintered diamond, and has a discoid shape or a ring shape. When the structure is a concentric structure, the temperature distribution becomes axially symmetric. When the temperature distribution is axially symmetric on the same material, a shearing stress associated with a Poisson ratio does not work in the radial direction. Because of this, the outer peripheral end part keeps an ideally circular shape, and the outer peripheral end is kept on the same plane. Accordingly, the blade works on the workpiece in a straight line by the rotation.

The blade 26 is integrally formed into the discoid shape by a diamond sintered body (PCD) which has been formed by sintering diamond abrasive grains. In this diamond sintered body, the content of the diamond abrasive grains (content of diamond) is 80% or more, and each of the diamond abrasive grains is bonded to others by a sintering aid (for instance, cobalt or the like).

The outer circumferential part of the blade 26 is a part which cuts into the workpiece W, and has a cutting edge part 40 which is formed into a shape of a thinner edge than the inside portion. In this cutting edge part 40, cutting edges (fine cutting edges) which are composed of fine recesses that are formed on the surface of the diamond sintered body are continuously formed with a fine pitch (for instance, 10 μm) along the circumferential direction of an outer peripheral end part (outer peripheral brim) 26*a* of the blade.

In the present embodiment, the thickness (thickness of edge) of the cutting edge part 40 is formed so as to be thinner at least than the thickness of the workpiece W. When the workpiece W of 100 μm, for instance, is subjected to the cutting process, the cutting edge part 40 is formed so as to have the thickness of preferably 50 μm or less, more preferably of 30 μm or less, and further preferably of 10 μm or less.

The cross-sectional shape of the cutting edge part 40 may be formed into such a tapered shape that the thickness becomes gradually thinner toward the outside (tip side), or may be formed into a straight shape having uniform thickness.

Figure 4A:
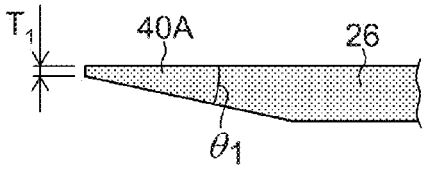
FIG. 4A is an enlarged sectional view showing one example of a structure of a cutting edge part.
Figure 4B:
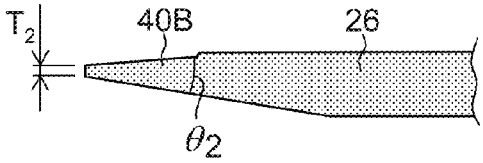
FIG. 4B is an enlarged sectional view showing another example of the structure of the cutting edge part.
Figure 4C:
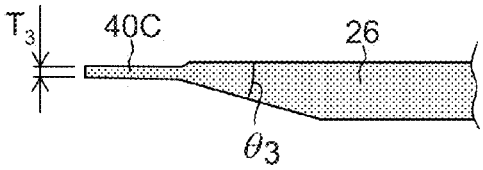
FIG. 4C is an enlarged sectional view showing further another example of the structure of the cutting edge part.

FIGS. 4A to 4C are enlarged sectional views showing structure examples of the cutting edge part 40. Incidentally, FIGS. 4A to 4C correspond to the portion in which the part B in FIG. 3 is enlarged.

The cutting edge part 40A shown in FIG. 4A is a one-side tapered type (one side V type) in which only the side face part in one side is diagonally made into a tapered shape. In this cutting edge part 40A, for instance, a thickness $T_1$ of the outer peripheral end part to be most thinly formed is 10 μm, and a taper angle $\theta_1$ of the portion is set at 20 degrees, in which the side face part in one side is made into a tapered shape. Incidentally, a thickness of an inside portion (except abutting region 36 which will be described later) of the blade 26 is 1 mm (which is similar also in FIGS. 4B and 4C).

A cutting edge part 40B shown in FIG. 4B is a double-side tapered type (double-side V type) in which the side face parts in both sides are diagonally made into tapered shapes. In this cutting edge part 40B, for instance, a thickness $T_2$ of the outer peripheral end part to be most thinly formed is 10 μm, and a taper angle $\theta_2$ of the portion is set at 15 degrees, in which the side face parts in both sides are made into the tapered shapes.

The cutting edge part 40C shown in FIG. 4C is a straight type (parallel type) in which the side face parts in both sides are made into a straight shape in parallel. In this cutting edge part 40C, a thickness $T_3$ of the tip part is set at, for instance, 50 μm, which has been most thinly formed into the straight shape. Incidentally, the side face part in one side in the inside portion (central side portion) of the straight-shaped tip part is made into a tapered shape, and a taper angle $\theta_3$ of the side face part is set at 20 degrees.

Figure 5:
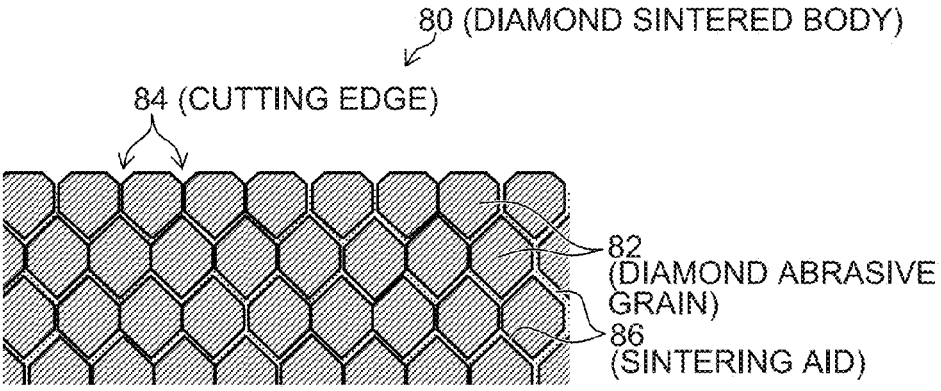
FIG. 5 is a schematic diagram schematically showing a state in the vicinity of the surface of a diamond sintered body.
Figure 19:
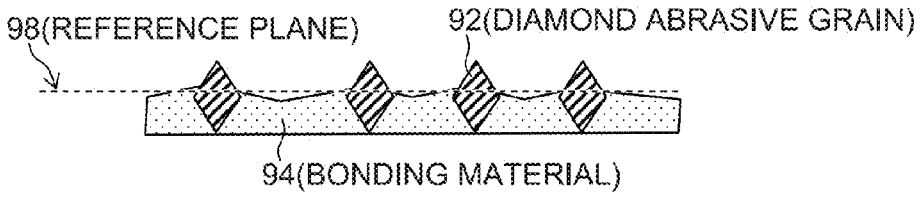
FIG. 19 is a schematic diagram showing a state of the surface of an electroformed blade.
Figure 20A:
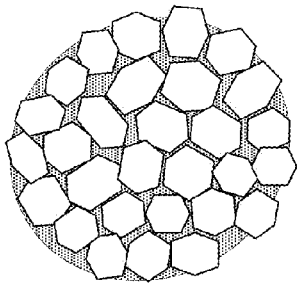
FIG. 20A is a schematic diagram showing a state of intervals between diamond abrasive grains, which corresponds to a content of the abrasive grains (case where content of abrasive grains is 80% or more).
Figure 20B:
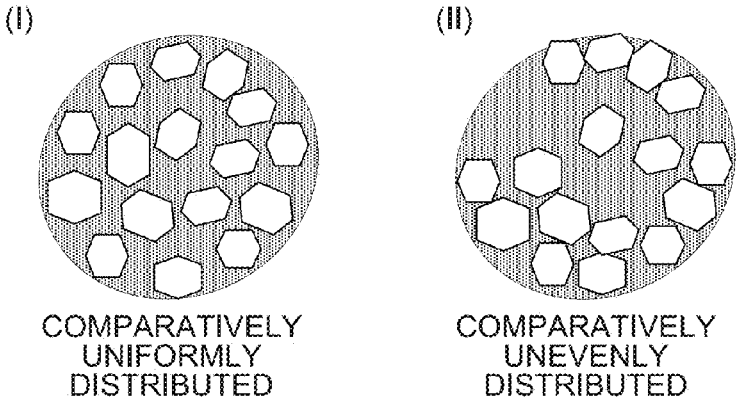
FIG. 20B is a schematic diagram showing a state of the intervals between the diamond abrasive grains, which corresponds to the content of the abrasive grains (case where content of abrasive grains is 70% or less).

FIG. 5 is a schematic diagram schematically showing a state in the vicinity of the surface of the diamond sintered body. As is shown in FIG. 5, the diamond sintered body 80 shows the state in which the diamond abrasive grains (diamond particles) 82 are bonded to each other with high density by a sintering aid 86. On the surface of this diamond sintered body 80, cutting edges (fine cutting edges) 84 are formed which are composed of fine recesses (recessed parts). The recesses are formed by a process in which the sintering aid 86 such as cobalt is selectively abraded by mechanically processing the diamond sintered body 80. The diamond sintered body 80 contains a high density of the abrasive grains, accordingly each of the recesses to be formed in a place in which the sintering aid 86 has been worn has a fine pocket shape, and there is no projection of a sharp diamond abrasive grain as in the electroformed blade (see FIG. 19). Because of this, each recess which is formed on the surface of the diamond sintered body 80 functions as a pocket which transports swarf that are generated when the workpiece W is subjected to the cutting process, and also functions as the cutting edge 84 which gives the cut onto the workpiece W. Thereby, the discharge performance for the swarf are enhanced, and the cut depth of the blade 26 for the workpiece W can be controlled with high precision.

Here, the blade 26 of the present embodiment will be described in more detail.

The blade 26 of the present embodiment is integrally composed of the diamond sintered body 80 which has been formed by sintering the diamond abrasive grains 82 with the use of the sintering aid 86, as is shown in FIG. 5. Because of this, there slightly exists the sintering aid 86 in gaps between the diamond sintered body 80, but the sintering aid diffuse also into the diamond abrasive grains itself, and actually the diamonds show a form of being strongly bonded to each other. Cobalt, nickel or the like is used as the sintering aid 86 of which the hardness is low in comparison with that of the diamond, and a portion in which the sintering aid is rich becomes slightly weak in strength in comparison with the single crystal diamond, though the diamonds are bonded to each other. Such a portion is worn and reduced when the workpiece W is processed, and forms a moderate recess with respect to the surface (reference plane) of the diamond sintered body 80. In addition, the diamond sintered body 80 is subjected to the wearing treatment process, and thereby the recess from which the sintering aid has been removed is formed on the surface of the diamond sintered body 80. In addition, when the diamond sintered body is dressed by a grinding stone for dressing, which is formed of GC (green carborundum), or occasionally when the diamond sintered body is used for cutting a super hard alloy which is formed of a hard brittle material, a part of diamonds in addition to the sintering aid is missed, and moderate roughness is formed in the outer circumferential part of the diamond sintered body. The roughness of this outer circumferential part is controlled to be larger than the particle size of the diamond, thereby missing of fine diamond abrasive grains are occurs in one cutting edge, and the wear of the cutting edge is unlikely to occur.

The recess formed on the surface of the diamond sintered body 80 effectively acts on the process in the ductile mode. Specifically, as has been described above, this recess functions as a pocket for discharging swarf which are generated when the workpiece W is subjected to the cutting process, and also functions as the cutting edge 84 which gives a cut onto the workpiece W. Because of this, the cut amount for the workpiece W is naturally restricted to a predetermined range, and avoids a fatal cut.

In addition, the blade 26 of the present embodiment is integrally composed of the diamond sintered body 80, and accordingly also the number, the pitch and the width of the recesses which are formed on the surface of the diamond sintered body 80 can be arbitrarily adjusted.

Specifically, the diamond sintered body 80 which constitutes the blade 26 of the present embodiment is formed by bonding the diamond abrasive grains 82 to each other with the use of the sintering aid 86. Because of this, there exist the sintering aid 86 among the diamond abrasive grains 82 which are bonded to each other and the grain boundary is present. This grain boundary portion corresponds to the recess, and accordingly, when the particle size (average particle size) of the diamond abrasive grains 82 is set, the pitch and the number of the recesses is naturally determined. In addition, the sintering aid 86 which employs a soft metal is used, thereby enabling to selectively process the recesses and also to selectively wearing the sintering aid 86. In addition, as for the roughness, the roughness can be adjusted by setting the conditions of the wearing treatment or the dressing treatment while rotating the blade 26. Specifically, it becomes possible to adjust the pitch, the width, the depth and the number of the cutting edges 84 which are composed of the recesses that are formed on the surface of the diamond sintered body 80, by the pitch of the grain boundaries to be formed depending on the selection of the particle size of the diamond abrasive grains 82. The pitch, the width, the depth and the number of the cutting edge 84 as in the above description play an important role when the blade performs the process of the ductile mode.

Thus, according to the present embodiment, a desired interval between the cutting edges 84 can be attained along the grain boundary of the crystal with high precision, by appropriately adjusting parameters which have adequate controllability, such as the selection of the particle size of the diamond abrasive grains 82, the wearing treatment and the dressing treatment. In addition, in the outer circumferential part of the blade 26, the cutting edges 84 which are composed of the recesses that are formed on the surface of the diamond sintered body 80 can be arranged in a straight line along a circumferential direction.

Here, as for a comparable blade, there is a wheel as a similar blade, which relates to a wheel formed by sintering the diamond abrasive grains and is used in a scribing process. In order to avoid confusion between the dicing blade and the scribing wheel, the difference will be positively described.

The wheel which is used in the scribing process is shown in Japanese Patent Application Laid-Open No. 2012-030992, for instance. In the above described document, a wheel is disclosed which is formed of the sintered diamond, and of which the toric edges have blade tips in the outer circumferential part. The scribing process and the dicing process of the present application tend to be considered to be both technologies for dividing a material and be in the same category, but are completely different in process principles and specific structures associated with the process principle.

Firstly, as for a definitive difference between the above described document and the present application, the scribing process in the above described document is an apparatus which forms a scribing line (longitudinal cracking) on the surface of a substrate formed of a brittle material, as is described in a paragraph [0020] of the above described document, and a vertical crack extending in a vertical direction occurs due to the scribing process (see paragraph [0022] of the above described document). The material is cut and divided by using this crack.

On the other hand, in the present application, a process method is proposed which removes a material in a shearing manner without forming a crack or chipping, and the principles are completely different. Specifically, the blade itself rotates at high speed, and works in an approximately horizontal direction to the surface of the workpiece to remove the workpiece, and accordingly a stress is not exerted on the workpiece face in the perpendicular direction. In addition, the cut depth is kept within a deformation region of the material, and the material is worked in such a cut depth that the crack does not occur. As a result, a surface having no crack is obtained after the process. From the above description, the process principle is completely different.

In consideration of the difference between the above process principles, a specific difference in the specification of the blade will be enumerated below.

(Point of Vertex Angle of Blade Tip)

In the scribing process, the blade only causes a crack in the inner part of a material, and accordingly does not almost enter into a material. Only the ridge line of the blade tip is made to act, and accordingly the angle of the blade tip is ordinarily a blunt angle (see paragraph [0070] of above described document). It is not considered at all to set the angle at an acute angle, much less 20 degrees or less, in consideration of a fracture due to twisting, and the like.

In contrast to this, in the dicing process, the blade enters the inner part of the material and removes the portion in which the blade has entered. Accordingly, the blade tip is straight or the vertex angle of the blade tip is a V shape at most in such a degree that bucking due to a dicing resistance in a travelling direction of the blade is considered. The vertex angle is 20 degrees or less at the maximum.

In addition, when the vertex angle is set at 20 degrees or more, the cross section after the cutting process becomes diagonal, the cross-sectional area increases, and besides, also in the viewpoint of a mechanism of the process, a volume of the material which is ground by the side face of the blade increases rather than a factor that the tip of the blade performs cutting. As a result, the efficiency of the process is lowered, and in some cases, the process does not progress. In the case of the dicing process, it is required that the cutting edges are formed on the outer circumference of the blade and the cutting edges on the tip progressively efficiently cut into the workpiece; and on the other hand, it is required for the blade to enhance lubricity between the side face of the blade and the workpiece, and to form a mirror-finished surface on the workpiece while decreasing the grinding amount. When the grinding amount by the side face of the blade increases, the grinding amount on the side face naturally increases, and the cross section after the cutting process cannot be mirror-finished. Therefore, in the dicing process, a straight shape is most desirable, but it is adequate that the shape is an extremely small V shape at the minimum in such a degree that the blade is not buckled, and the vertex angle is at most 20 degrees or less.

(Point of Material Composition)

In the scribing process, when the travelling direction has changed in such a state (entering state) that the wheel abuts on the workpiece, the blade tip is occasionally fractured by a stress due to the twisting. Because of this, even though the wheel is formed of the diamond sintered body, the content of the diamond is set at 65% to 75% by weight. As a result, not only the wear resistance and the impact resistance but also twisting strength properties are enhanced. If the content of the diamond is set at 75% by weight or more, the hardness of the wheel itself increases, but the twisting strength properties decrease. Therefore, the content of the diamond is set at a comparatively small value.

On the other hand, in the dicing process, the blade rotates at high speed, and linearly advances while removing a fixed amount of the material. Because of this, the stress due the twisting is not exerted on the blade. Instead, in the case where the content of the diamond is small, when the blade cuts, the apparent hardness is lowered. Accordingly, there is the case where the blade cannot keep a predetermined cut depth because of the reaction force from the workpiece, or because the elasticity of the workpiece recovers within a time period in which the cutting edge of the blade cuts. Because of this, in the case of the dicing process, the hardness of the blade has sufficiently high hardness in comparison with the hardness of the workpiece so that the blade can progressively cut into the workpiece without causing a bounce while keeping a predetermined cut. In order that the blade progresses the process without allowing the workpiece to recover elasticity within a time period in which the cutting edge acts in the process, within the deformation region of the material in the ductile mode, the surface hardness is needed to be equivalent to that of the single crystal diamond (approximately 10,000 by Knoop hardness), and approximately 8,000 by the Knoop hardness becomes necessary. As a result, the content of the diamond needs to be 80% or more. However, when the content of the diamond is 98% or more, a ratio of the sintering aid extremely decreases. Accordingly, the power of bonding the diamonds to each other becomes weak, the toughness of the blade itself is lowered, and the blade becomes fragile and tends to be easily chipped. Therefore, the content of the diamond needs to be 80% or more, and is desirably 98% or less, in consideration of a practical point.

From the above description, the PCD which is used in the scribing wheel and the PCD which is used in the dicing blade of the present application use the same material, but have completely different process principles, and accordingly required compositions of the PCD, specifically, contents of the diamond become completely different.

(Point of Wheel Structure and Reference Surface)

Furthermore, the structure of the wheel is different. The scribing wheel has a holder, and the holder is an element of rotatably holding the scribing wheel. The holder mainly has a pin and a support frame body, and accordingly the portion (portion of shaft) of the pin does not rotate. The inner diameter part of the wheel becomes a bearing, relatively rubs on the portion of the pin which is a shaft, thereby rotates and forms a scribing line (longitudinal cracking) in a direction perpendicular to the surface of the material.

In contrast to this, the blade according to the present invention is coaxially mounted on the rotating spindle. The spindle and the blade integrally rotate at high speed. It is necessary to mount the blade vertically to the spindle shaft, and to eliminate run-out due to the rotation.

Because of this, the reference plane exists in the blade. The reference surface existing in the blade is abutted on the reference end face of the flange which has been previously mounted vertically on the spindle, and is fixed. Thereby, the vertical degree to the spindle rotation axis of the blade is secured. Only when this vertical degree is secured, the cutting edges formed in the outer circumferential part work on the workpiece in a straight line by the rotation of the blade.

In addition, the reference surface in the case of the scribing process is specified on the basis of a premise that a cylindrical plane in parallel with the shaft of a discoid blade vertically presses the blade. However, the reference surface of the blade in the blade of the present application is a side part end face (discoid plane) of the blade, which faces the flange of the spindle, as has been described above. The reference surface of the blade is determined to be a side face (discoid plane) of the blade, and thereby the blade rotates with high precision in the state of being balanced with respect to the center of the blade. Even when the blade rotates at high speed, the cutting edge which has been formed on the tip of the blade works in a predetermined height position which is defined by a fixed radial position with reference to the center of the blade, with high precision, and horizontally works on the workpiece face without exerting a vertical stress on the workpiece in a predetermined height to just remove the workpiece. Because of this, even if the workpiece is a brittle material, the blade does not cause a crack by a stress vertical to the workpiece face.

(Point of Process Principle)

It is a definitive difference between the principles of the scribing process and the dicing process of the present application whether the machining is performed by giving cracks in the vertical direction or without causing any cracks.

(Role of Groove of Outer Circumferential Edge)

In addition, in the scribing process, a pressure is applied to only the surface by a vertical stress of the scriber, and thereby the scribing line is formed. The role of the groove of the outer circumferential edge in the case of the scribing process is to cause a crack vertical to the material while the projecting part of the blade tip of the wheel abuts on (entering) a substrate of the brittle material (see paragraph [0114] of above described document). Specifically, the groove is such a groove that a portion other than the groove can form such a degree of the scribing line as to enter the material and cause a vertical crack. Therefore, it becomes important how a mountain portion between the grooves enters the material, rather than the groove.

In contrast to this, in the case of the dicing process, the recessed part provided on the outer peripheral end part plays a role of the cutting edge. The portion between the recessed parts forms a contour of the outer circumference, and the cutting edge provided therebetween is set so as to give the critical cut depth in such a degree as not to cause the crack onto the surface of the workpiece. Therefore, in the case of the dicing process, it is necessary to form the cutting edge.

In addition, the groove depth in the case of the scribing process is formed into a groove depth in such a degree as to give the entering amount for forming the scribing line, but in the case of the dicing process, the cutting edge enters into the workpiece, and each of the cutting edges must grind and remove the workpiece. Because of this, the cutting edge must act vertically on the workpiece face down to the deep part of the material while the tip of the blade completely enters into the workpiece, and the run-out of the blade is not allowed.

The blade according to the present invention has the cutting edges of the recessed parts at constant intervals in the outer peripheral end part. The interval between the cutting edges may be such a degree that the critical cut depth given by one cutting edge does not cause the crack, as will be described later. For this purpose, it is necessary to properly keep the interval between the cutting edges.

In addition, in the case of the scribing wheel, the direction of the blade tip of the scribing wheel is changed by 90 degrees while the scribing wheel abuts on the brittle material. This effect is referred to as a caster effect.

In the dicing blade, the edge enters into the material, and accordingly the direction of the blade tip cannot be changed by 90 degrees. For instance, when the blade tip of the dicing blade having a straight shape or the vertex angle of 20 degrees or less is shifted while abutting the material, the edge is broken.

Incidentally, in the case of the diamond sintered body 80 which has been sintered by using the sintering aid 86 composed of a soft metal, wearing treatment, dressing treatment and the like are the most suitable as a method for forming the recess on the surface, but the method is not limited to the treatments. When the sintering aid such as cobalt and nickel is used, for instance, it is also possible to form the recesses on the surface of the diamond sintered body 80, by chemically dissolving the diamond sintered body partially with acidic etching.

In contrast to this, in the conventional electroformed blade, the diamond abrasive grains themselves play a role of the cutting edges, but in order to adjust the pitch, the width and the like of the cutting edges, the adjustment needs to rely on the dispersion degree of dispersing the diamond abrasive grains in an early stage, and accordingly the adjustment is technically difficult. Specifically, the pitch and the width largely include the ambiguity of the dispersion of the diamond abrasive grains, and substantially cannot be controlled. In addition, even when there exist a portion in which the diamond abrasive grains are insufficiently dispersed and are aggregated, or when a portion in which the diamond abrasive grains are excessively dispersed and sparse, it is difficult to arbitrarily adjust the pitch and the width. Thus, in the conventional electroformed blade, it is impossible to control the arrangement of the cutting edges.

In addition, in the conventional electroformed blade, there is no technique of artificially arranging the diamond abrasive grains of micron orders one by one, in the present technology, and it is almost impossible to efficiently align and arrange the cutting edges in a straight line. In addition, in the conventional electroformed blade in which the dense portion and the sparse portion of the cutting edges are mixed, and in which the arrangement of the cutting edges cannot be substantially controlled, it is difficult to control the cut amount to the workpiece W, and it is theoretically impossible to perform the process in the ductile mode.

In the blade 26 of the present embodiment, the average particle size of the diamond abrasive grains contained in the diamond sintered body is preferably 25 μm or less (more preferably is 10 μm or less, and further preferably is 5 μm or less).

According to experimental results which the present inventors have performed, when the average particle size of the diamond abrasive grains is 50 μm, in the case where a wafer material is SiC, the crack has occurred when the dicing process has been performed in the cut amount of 0.1 mm. Probably, it should be a factor that the diamond has fallen off. When the diamond abrasive grains with the diamond average particle size of 50 μm or more have been sintered, an area decreases in which the diamond particles adhere to each other, and the large particles are bonded to each other at a local area. Because of this, the blade has disadvantages of having extremely weak impact resistance, and being easily chipped, in the viewpoint of the composition of the material. When the diamond has fallen off in a unit of 50 μm or more by a local shock, the fall becomes a trigger and an extremely large cutting edge is formed. In this case, the cutting edge behaves as an isolated cutting edge, and gives a cut depth which is a predetermined critical cut or more. As a result, it stochastically becomes extremely high to cause chipping and cracks. In addition, when the diamond of approximately 50 μm has fallen off, not only the cutting edge in a remaining portion becomes large, but also the diamond abrasive grains themselves, which have fallen off, are entangled between the workpiece and the blade, and occasionally further cause the cracks. When the diamond abrasive grains are fine particles of 25 μm or less, there is no result that the cracks regularly occur.

Figure 6:
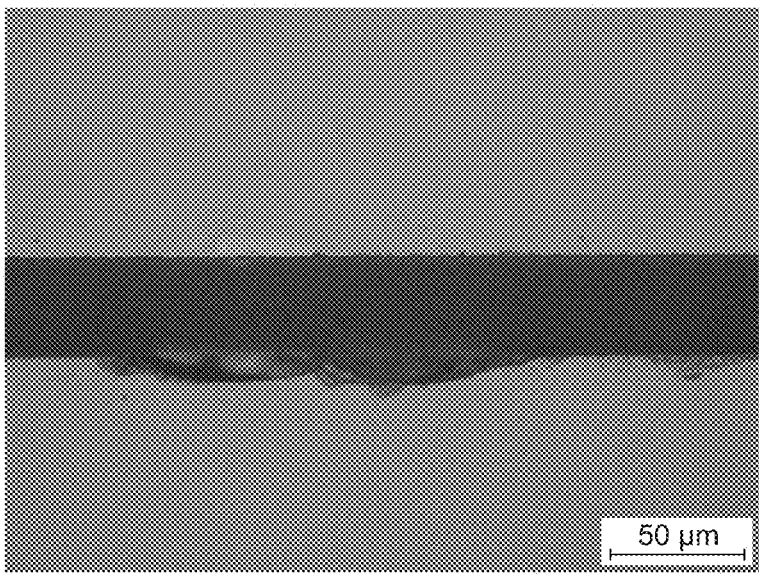
FIG. 6 is a view showing a state of a surface of a workpiece when the blade which is formed of the diamond abrasive grains having an average particle size of 50 μm is used for performing the grooving process on the workpiece, and showing an example in which a crack occurs.

FIG. 6 shows a state of the surface of a workpiece in the case where the grooving process has been performed by a blade formed of diamond abrasive grains having an average particle size of 50 μm, and shows an example in which the cracks have occurred.

In addition, Table 2 shows results obtained by having evaluated the occurrence ratio of the cracks or chipping when the grooving process has been performed by the blades of which the average particle sizes of the diamond abrasive grains are each set at 50 μm, 25 μm, 10 μm, 5 μm, 1 μm and 0.5 μm. The evaluation results show that the occurrence ratio of the cracks or chipping becomes higher, in order of A, B, C and D. Other conditions are as follow.

Standard evaluation condition: SiC substrate (4H) (hexagonal crystal)

Rotation number of spindle: 20,000 rpm

Feeding speed: 1 mm/s

Cut depth: 100 μm

Guideline of evaluation: The result is evaluated whether there is a chipping of 10 μm or more, or not. (Ideally, there is completely no chipping.)

TABLE 2

| | Average particle size of diamond | | | | | |
|---|---|---|---|---|---|---|
| | 50 | 25 | 10 | 5 | 1 | 0.5 |
| Occurrence of crack or chipping | D Chipping is easily formed. | C Occasionally occurs but almost none. | B | A | A | B |

In addition, in sapphire, the crack occurred when the cut was 0.2 μm. The crack occurred also in quartz and silicon when the cut was similar to that in the sapphire.

Furthermore, when the average particle size of the diamond abrasive grains is 50 μm, it is also difficult to set the edge thickness (thickness of outer peripheral end part of blade) of the blade at 50 μm or less, and many edge chippings occur in the outer circumferential part of the blade 26, when the blade 26 is manufactured. In addition, even when it was intended to manufacture the blade having an edge thickness of 100 μm (0.1 mm), large gaps were formed in some portions, and furthermore the blade was occasionally broken by a little shock. Thus, it was practically difficult to stably manufacture the blade.

On the other hand, in the case where the average particle sizes of the diamond abrasive grains were 25 μm, 5 μm, 1 μm and 0.5 μm, even when the cut similar to the case of the average particle size of 50 μm was performed, the cracks did not occur even in each of the brittle materials of the SiC, the sapphire, the quartz and the silicon. Specifically, in these brittle materials, when the average particle size of the diamond abrasive grains is 50 μm, the cracks occur by the cut of sub-micron order, and when the diamond abrasive grains having the average particle size of more than 50 μm are used, the cut naturally becomes large, which causes a fatal crack. In contrast to this, when the diamond abrasive grains having the average particle size of 25 μm or less (more preferably of 10 μm or less, and further preferably of 5 μm or less) are used, the cut can be controlled to be small, and it becomes possible to control the cut depth with high precision.

Incidentally, as for general machining conditions of the present experiment, the outer diameter of the blade is 50.8 mm, the size of the wafer is 2 inches, the grooving process is performed with the cut of 10 μm, the rotation number of the spindle is 20,000 rpm, and the table feeding speed is 5 mm/s.

As for a method for manufacturing the blade 26 which is structured in this way, fine powders of diamond are placed on a base which contains tungsten carbide as a main component, and are charged in a mold. Subsequently, a solvent metal (sintering aid) such as cobalt is added into this mold, as the sintering aid. Subsequently, the powders are fired and sintered under an atmosphere of a high pressure of 5 GPa or higher and a high temperature of 1,300° C. or higher. Thereby, the diamond abrasive grains are directly bonded to each other, and an extremely strong ingot of the diamond is formed. Thus, a columnar ingot can be obtained which has a size of, for instance, a diameter of 60 mm, a sintered diamond layer (diamond sintered body) of 0.5 mm and a tungsten carbide layer of 3 mm. There are DA200 made by Sumitomo Electric Hardmetal Corp., and the like, as the diamond sintered body which has been formed on the tungsten carbide. The blade 26 of the present embodiment can be obtained by taking out only the diamond sintered body, and subjecting the blade substrate to outer circumference wearing treatment or outer circumference dressing treatment process so as to be formed into a predetermined shape. Incidentally, it is preferable to polish the surface (except cutting edge part 40) of the diamond of the columnar ingot by scaif (scaif: disc for polishing) beforehand so as to have a mirror surface having a surface roughness (arithmetic average roughness Ra) of approximately 0.1 μm, in order to form the reference surface for eliminating the run-out during the rotation.

Here, the wearing treatment and dressing treatment in the above described manufacturing method can be set at the following conditions.

There are the following conditions and the like for the wearing treatment.

Rotation number of blade: 10,000 rpm

Feeding speed: 5 mm/s

Object to be worked: silica glass (glass material)

Process treatment period: 30 minutes

Through the above described treatment, a cobalt sintering aid which is as small as approximately 1 to 2 μm was removed, and the recess was formed. Furthermore, an extremely thin etchant (weak acidic) was applied to the blade, the blade was treated in a dry environment without the supply of pure water, and thereby the recess became deeper.

The conditions for the dressing treatment (wearing treatment) may be the following.

Rotation number of blade: 10,000 rpm

Feeding speed: 5 mm/s

Object to be worked: GC600 dressing grinding stone (70 mm sq.) (GC600 means grain size No. 600 (#600) of grinding material formed of silicon carbide.) The grain size is based on Japanese Industrial Standards (JIS: Japan Industrial Standards) R6001.

Process treatment period: 15 minutes

In this treatment as well, the cobalt sintering aid was slightly removed, and the recess was formed.

Incidentally, it is desirable that the outer peripheral end part of the blade and the side face part of the blade out of the outer circumferential parts of the blade have different roughness from each other. Specifically, the outer peripheral end part of the blade corresponds to the cutting edge, and the interval between the cutting edges shall be adjusted along the crystal grain boundary by the wearing treatment. The outer peripheral end part of the blade, in particular, machines and removes the workpiece material largely to some extent while entering the cut into the workpiece material, and accordingly is worked so as to be slightly rougher.

On the other hand, the side face part of the blade does not positively perform machining and removing, and may be roughened in such a degree as to skive the side face part of the groove of the workpiece material when having come in contact with the side face part of the groove. In addition, when there is a projection on the side face part of the blade, the projection induces cracking on the side face part of the groove. Accordingly, it is necessary to machine the side face part of the blade so as not to have the projection part formed thereon, and on the other hand, to reduce a contact area between the side face part of the blade and the side face part of the groove, and alleviate the generation of heat due to friction even slightly. For the purpose, it is desirable to finely roughen the side face part.

The conventional electroformed blade or the like is manufactured so that the abrasive grains are fixed by plating, and accordingly the whole surface shows uniform abrasive grain distribution, and as a result, it has been impossible to largely differentiate the deposition form of abrasive grains between the outer peripheral end of the blade and the side face of the blade. Specifically, it has been impossible to clearly differentiate the situations of the roughness between the outer peripheral end part of the blade for progressively cutting into the workpiece and the side face part which is determined to be such a degree as to finely shave the workpiece while being rubbed with the workpiece.

The blade according to the present invention is composed mostly of the diamond, and can be subjected to forming process from the state. For instance, the blade according to the present invention may be subjected to diamond wrapping so that the side face part is roughened. When the surface is roughened by fine diamonds (with particle size of 1 μm to 150 μm), the roughness of which the Ra is approximately 0.1 μm to 20 μm, for instance, can be formed.

On the other hand, the outer circumferential part of the blade is different from the side face part of the blade, and needs to progressively cut into the workpiece while machining the workpiece. Accordingly, it is better to give roughness functioning as the cutting edge to the outer circumferential part, which is different from the side face part. Such a roughness can be formed as the cutting edge on the outer circumferential part, for instance, by a pulse laser or the like.

When the cutting edge is formed by the pulse laser, the following conditions are preferably used.

Laser oscillator: Fiber laser made by IPG Photonics Corporation in U.S.A.: YLR-150-1500-QCW Feeding table: JK702

Wavelength: 1,060 nm

Power: 250 W

Pulse width: 0.2 msec

Focal position 0.1 mm

Rotation number of workpiece 2.8 rpm

Gas: high-purity nitrogen gas: 0.1 L/min

Pore diameter 50 μm

Material of workpiece blade: DA150 made by Sumitomo Electric Industries, Ltd. (particle size of diamond of 5 μm)

Outer diameter 50.8 mm

Figure 21:
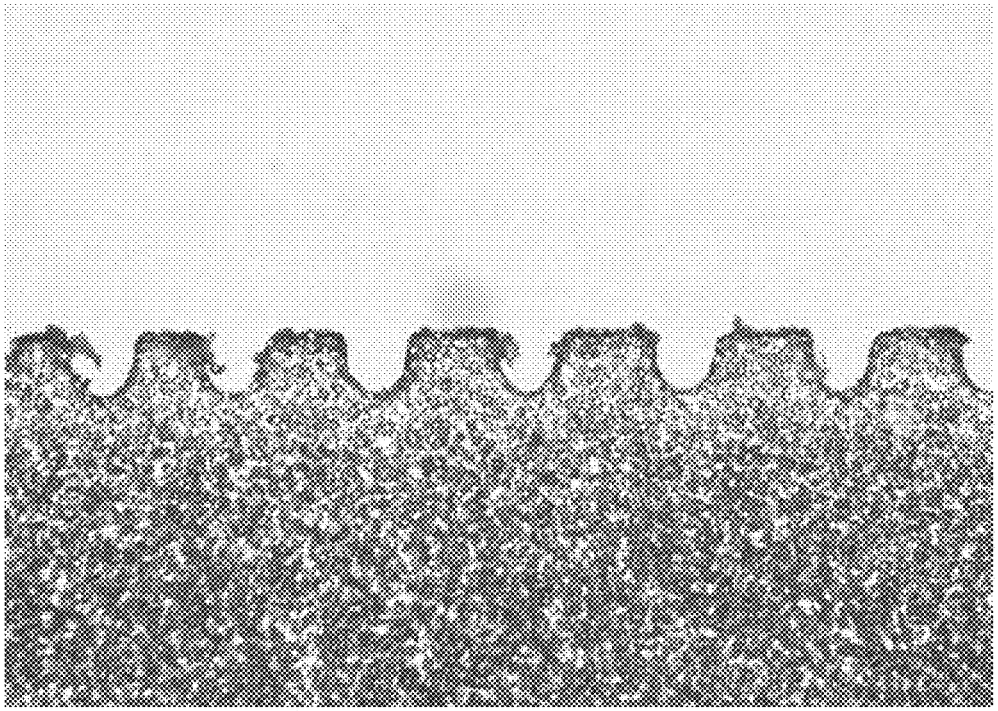
FIG. 21 is a sectional view of the outer peripheral end of the blade in the case where the cutting edge is formed by a fiber laser (holes of 50 μm at 100 μm intervals).

By such a pulse type fiber laser, sharp cutting edges can be formed which have semicircular shape with a diameter of 0.05 mm, and are continuously arranged on the outer peripheral end of the blade at constant intervals with a pitch of 0.1 mm, as is shown in FIG. 21. In thus formed cutting edge, one cutting edge itself can be formed into a cutting edge of 50 μm, though the particle size of diamond is 5 μm. In addition, if the cutting edges are formed at even intervals, apparent intervals become small by increasing the rotation number to high, and the dicing in the ductile mode is enabled (for instance, when rotation number of spindle is 10,000 rpm or more, and the like).

With using the fiber laser, the cutting edges can be formed to have such various pore diameters that the sizes of one cutting edge are approximately 5 μm to 1 mm which is large, but usually the cutting edge can be formed to have a size of approximately 5 μm to 200 μm, because of the beam diameter of the laser.

In the electroforming method and the like, a notch is formed from a material in which diamond is fixed by plating. Unlike that method, the material is formed of the sintered diamond into a discoid shape, and fine notches are continuously formed on the outer peripheral end of the discoid shape. Thereby, each of the notches works as the cutting edge.

Japanese Patent Application Laid-Open No. 2005-129741 describes a method for forming notches on the outer circumferential part of the blade which has been manufactured by the electroforming method, but the notch in this case is provided as a function of discharging swarf and a function of preventing clogging, and is not provided as the cutting edge. When the blade is manufactured by the electroforming method, the diamond does not necessarily exist in the edge portion of the notch, but exists together with the bonding material. Accordingly, because the bonding material is worn along with the work, the notch of the material does not work as the cutting edge.

In contrast to this, when the blade is formed of the diamond sintered body, the tip of the cutting edge which has been opened on the outer circumferential part works as the cutting edge in that state. In addition, the size of the diamond abrasive grain is 5 μm which is small in comparison with the size of the cutting edge of 50 μm, and accordingly it also becomes possible that a small cutting edge is spontaneously generated in the cutting edge, due to a phenomenon that one diamond abrasive grain is chipped and falls off in one cutting edge. In the grinding stone in the conventional electroforming method, the diamond abrasive grain works as the cutting edge in the state, and accordingly the size of the cutting edge and the spontaneous generation unit is the same. However, in the case of the present invention, the arbitrary cutting edges are formed, and thereby the size of the cutting edge and the unit of the spontaneous generation of the diamond in the cutting edge can be changed. As a result, the sharpness can be secured for a long period.

Furthermore, the roughness of the outer peripheral end part of the blade is made large in comparison with the roughness of the side face part of the blade, and thereby while the outer peripheral end of the blade progressively cuts into the workpiece, the side face of the blade can grind the workpiece with its finely roughened surface to mirror-finish the workpiece. Conventionally, in the blade by the electroforming method, it has been difficult and substantially impossible to independently change the roughness of the outer peripheral end part and the roughness of the side face part. However, when the sintered diamond is used as in the present invention, it becomes possible to arbitrarily form the cutting edges at even intervals on the outer peripheral end part, while forming a finely roughened surface on the side face of the blade. Thereby, it becomes possible that while securing the sharpness of the outer circumference and efficiently progressively cutting into the workpiece, the blade completely independently performs a mirror-finish process on the side face of the workpiece.

In addition, in a structure that only the outer circumference of the blade is embedded with high-hardness diamond chips one by one (for instance, Japanese Patent Application Laid-Open No. 7-276137, or the like), the cutting edges may be formed at even intervals, but are not formed of an integral disc-shaped PCD. Accordingly, as has been described above, it is clear that the structure is completely different from that of the blade of the present application, in the points of the thermal conduction, the flatness of the shape, the continuity of the flat surface, a property of exerting a locally effective shearing force on the workpiece without absorbing the impact caused by the work, and a property of performing the process in the ductile mode.

The interval between the cutting edges and the roughness of the surface of the side face part are appropriately adjusted according to the material to be worked.

Figure 7:
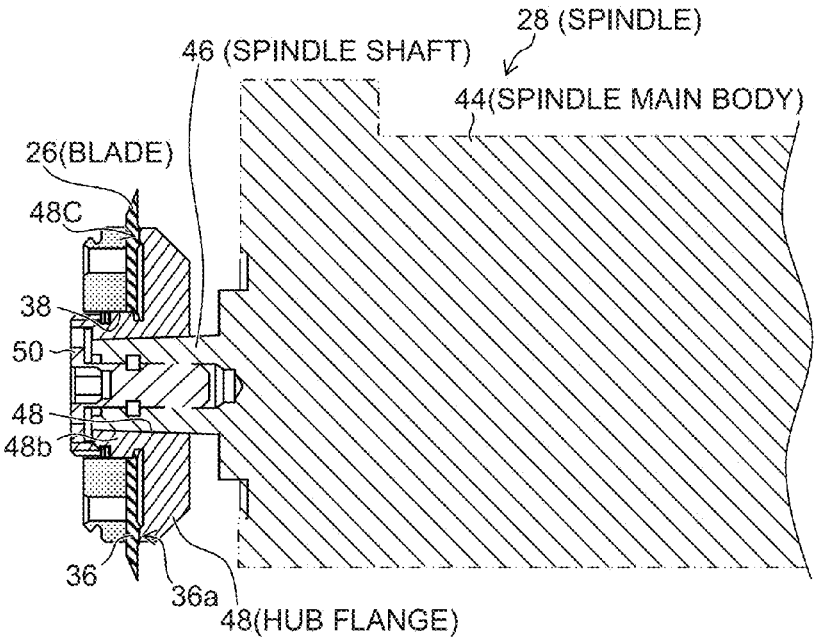
FIG. 7 is a sectional view showing a state in which the dicing blade is mounted on a spindle.

FIG. 7 is a sectional view showing a state in which the blade 26 is mounted on a spindle 28. As is shown in FIG. 7, the spindle 28 mainly includes: a spindle main body 44 which houses a motor (high-frequency motor) (not shown) therein; and a spindle shaft 46 which is rotatably supported by the spindle main body 44 and is arranged in the state in which the tip part projects from the spindle main body 44.

A hub flange 48 is a member which is placed between the spindle shaft 46 and the blade 26, has a mounting hole 48*a* provided therein which is formed into a tapered shape, and has a cylindrical projection part 48*b* provided thereon. This hub flange 48 has a flange surface 48*c* provided thereon which becomes a reference surface for determining a vertical degree of the blade 26 to the spindle shaft 46 (rotation axis). A blade reference surface 26*a* of the blade 26 abuts on this flange surface 48*c*, which will be described later.

The blade 26 has an annular part (abutting region) 36 provided on end face of one side, which is formed in the inner side and has a thicker wall than the cutting edge part 40 (see FIG. 2 and FIG. 3). This annular part 36 has the blade reference surface 36*a* formed thereon on which the flange surface 48*c* of the hub flange 48 abuts. The blade reference surface 36*a* is preferably provided at a position higher than the other positions on the end face on which the annular part 36 is formed, and the flatness is thereby easily obtained. In addition, the thickness of the annular part 36 which includes the blade reference surface 36*a* needs to be controlled to be sufficiently thick in comparison with the cutting edge part 40 provided on the outer circumferential part of the blade.

The outer circumferential part of the blade needs to have also cutting width thinly formed so as not to cause a brittle fracture on the surface of the material during the cutting process, and the thickness needs to be controlled to 50 μm or less.

However, when the blade is manufactured so that the thicknesses of all portions are 50 μm or less, which contain the blade reference surface part, while keeping the thickness at the thickness of the outer circumferential part of the blade, the processing distortion becomes a large problem, which occurs when the blade has been machined in a process of flattening. When the whole surface of the blade has been manufactured so as to have a thickness of approximately 50 μm, in particular, the blade is warped in one side due to the balance of mutual distortions occurring in both side faces of the blade. When the blade is warped even with a small extent, the blade is buckled and deformed to a side in which the blade is originally warped by an extremely small stress, because the outer peripheral end part is extremely thin, and consequently the blade cannot be used.

Because of this, a portion at which the blade reference surface is formed should not have such a thickness as to cause the warpage due to the distortion even if the processing distortion has remained on the surface of the blade. When the blade is a circle plate having a diameter of approximately 50 mm, such a thickness of the reference surface portion of the blade as not to cause the warpage due to the processing distortion is 0.25 mm or more at the minimum, and is preferably 0.5 mm or more. The blade reference surface portion needs to have a thickness of that degree, otherwise, the blade cannot keep the flat surface as the blade reference surface. When the flat surface cannot be kept, it becomes difficult to make the outer peripheral end part of the blade work on the workpiece in a straight line.

From the above description, the blade 26 of the present embodiment needs to satisfy the following conditions.

Specifically, the blade reference surface 36*a* must keep the flat surface even when the processing distortions on both side faces of the blade 26 have been unbalanced, and accordingly the thickness of the reference surface part needs to be 0.3 mm or more at the minimum.

On the other hand, the outer peripheral end part of the blade must perform process so as to occupy an extremely small region, also in order not to induce the crack on the material. For this purpose, the thickness of the cutting edge part 40 which is provided on the outer circumferential part of the blade needs to be controlled to 50 μm or less.

In other words, when the whole blade having a diameter of 50 mm, for instance, is considered, all portions of the blade need to be integrally manufactured so as to keep the flatness. Then, the inner peripheral part of the blade must be thickly formed so as to keep the flatness, and on the other hand, the outer circumferential part of the blade must be thinly formed.

Incidentally, a mirror-finish process by scaif polishing or the like can be used as the method for enhancing the flatness.

As for a process of mounting the blade 26, firstly, the spindle shaft 46 which has been formed into a tapered shape is fitted to the mounting hole 48*a* of the hub flange 48, and the hub flange 48 is positioned and fixed to the spindle shaft 46 by fixing means (not shown). Subsequently, a blade nut 52 is screwed to a screw part which is formed on the tip of the projection part 48*b*, in the state in which the mounting hole 38 of the blade 26 is fitted into the projection part 48*b* of the hub flange 48, and thereby the blade 26 is positioned and fixed to the hub flange 48.

Thus, when the blade 26 has been mounted on the spindle shaft 46 through the hub flange 48, the vertical degree of the blade 26 to the spindle shaft 46 is determined by the flatness of the flange surface 48*c* of the hub flange 48, the flatness of the blade reference surface 26*a* of the blade 26, and the mounting precision at the time when both of the flange surface 48*c* and the blade reference surface 26*a* are overlapped. Because of this, it is preferable that the flange surface (surface perpendicular to rotation axis) 48*c* of the hub flange 48 and the blade reference surface 26*a* of the blade 26, which comes in contact with this flange surface 48*c*, are flattened by the mirror-finish process, for instance, and are formed so that the vertical degree to the spindle shaft 46 becomes highly precise. Thereby, when the blade 26 is mounted on the spindle shaft 46 through the hub flange 48, the blade 26 is positioned and fixed in the state in which the flange surface 48*c* and the blade reference surface 26*a* are brought into contact with each other, and thereby can be controlled to be vertical to the spindle shaft 46 with high precision.

In addition, the precision of the central position of the blade 26 is determined by the fitting precision between the mounting hole 38 of the blade 26 and the projection part 48*b* of the hub flange 48; and accordingly the coaxiality of the blade 26 and the hub flange 48 can be secured by enhancing the machining precision of the inner peripheral surface of the mounting hole 38 and the outer peripheral surface of the projection part 48*b*, and adequate mounting precision can be achieved.

As a result, the highly-precise mounting precision of the blade to the spindle shaft 28 in addition to the precision of the single body of the blade is secured, and thereby the highly-precise cutting process can be achieved.

Specifically, in order to perform process in the ductile mode, the blade 26 needs not only to have the thickness of the cutting edge part 40 thinly structured, but also to be mounted with high precision on the rotation axis so that the cutting edge part 40 can work in an approximately straight line in a direction perpendicular to the rotation axis (spindle shaft 28) of the blade 26. At this time, the required precision can be sufficiently satisfied.

In the present embodiment, the hub flange 48 and the spindle shaft 46 which support the blade 26 are formed from a metal material such as stainless steel (SUS304, for instance; stainless steel in SUS304 is stainless steel based on Japanese Industrial Standards (JIS: Japan Industrial Standards), and stainless steel in present embodiment is hereinafter based on Japanese Industrial Standards). On the other hand, the blade 26 is integrally formed of the diamond sintered body 80, as has been described above. Specifically, the blade reference surface 36*a* is structured so as to be supported by the metal reference surface. According to such a structure, even if the cutting edge part 40 of the outer circumferential part of the blade generates heat by the cutting process, or even if the heat is generated in the spindle shaft 46 side, firstly, the heat is uniformly conducted to the inside of the blade 26. Specifically, the blade 26 is formed of the diamond sintered body 80 having extremely high thermal conductivity, but in contrast to this, the hub flange 48 and the spindle shaft 46 which support the blade 26 are formed from stainless steel having remarkably low thermal conductivity in comparison with the diamond sintered body 80. Because of this, the heat generated in the components conducts in the circumferential direction along the blade 26, and is uniformized in the circumferential direction of the blade 26 at once. Accordingly, the temperature distribution becomes a radial shape. The heat conducts only to the diamond portions at once, and the heat resists conducting to the spindle shaft 46 and the hub flange 48 which are formed from the stainless steel, because of the cross-sectional area and the like, and also because there are few contact parts. Consequently, the uniformization of the heat is further promoted in the diamond portion, and thermal balance is secured in the uniformized state.

In addition, in the outer circumferential part of the blade, there exists no member which obstructs thermal expansion, and there is no bimetal effect. Accordingly, the outer circumferential part of the blade 26 can adequately keep circularity and flatness. As a result, the cutting edges 84 which are provided on the outer peripheral end part of the blade work on the workpiece W in a straight line.

Incidentally, the blade 26 shown in the present embodiment is structured so as to be mounted on the spindle shaft 46 through the hub flange 48, but the blade 26 may be structured so as to be mounted directly on the spindle shaft 46. A similar effect can be obtained.

Next, a dicing method with the use of the blade 26 of the present embodiment will be described below. This dicing method is a method which plastically deforms a brittle material such as silicon, sapphire, SiC (silicon carbide) and glass without causing a brittle fracture such as a crack and chipping therein, and can simultaneously stably perform the cutting process on the brittle material with high precision.

Firstly, the workpiece W is taken out from the cassette mounted on the load port 12, and is mounted on the worktable 30 with the transporting means 16. The surface of the workpiece W mounted on the worktable 30 is imaged by the imaging means 18, and the position of the line on the workpiece W, on which the workpiece W is diced, and the position of the blade 26 are aligned by the worktable 30 of which the position is adjusted by each of the moving shafts of X, Y and θ (not shown). When the alignment of the positions have been ended and the dicing is started, the spindle 28 starts rotating, and the spindle 28 moves down to a predetermined height in a Z direction only by the amount of the cut or grooving which the blade 26 performs on the workpiece W. Then, the blade 26 rotates at high speed. In this state, the workpiece W is fed for the machining to the blade position together with the worktable 30 in an X direction shown in FIG. 1, by the moving shaft (not shown), and is subjected to dicing by the blade 26 which is mounted on the tip of the spindle that has been moved down to the predetermined height.

At this time, the cut depth (cut amount) of the blade 26 with respect to the workpiece W is set. The cut depth must be set so that when the blade 26 which has a large number of cutting edges on the outer circumference rotates at high speed, one cutting edge (fine cutting edge) 84 reaches a critical cut depth (Dc value) or shallower. This critical cut depth is the maximum cut depth at which the blade can perform the cutting process in the ductile mode by the plastic deformation without causing the brittle fracture of the brittle material.

Here, a relationship between the workpiece material and the critical cut depth per one edge, which does not cause a crack, is shown in Table 3.

TABLE 3

| Workpiece material | Critical cut depth Dc value [μm] |
|---|---|
| SiC | 0.26 |
| $Si_3N_4$ | 1.98 |
| $Al_2O_3$ | 1.03 |
| $ZrO_2$ | 6.22 |
| Si | 0.15 |

As is understood from Table 3, when the workpiece material is silicon, for instance, the critical cut depth is 0.15 μm, and accordingly the cut depth of the blade 26 into the workpiece W is set at 0.15 μm or less. If the cut depth exceeds 0.15 μm, it cannot be avoided that the crack occurs in the workpiece material.

In addition, it is understood that out of the workpiece materials shown in Table 3, the critical cut depth (0.15 μm) of the silicon is smallest, and silicon is easily broken in comparison with the other materials. From the relationship, in most materials, when the cut depth is 0.15 μm or less, the process in the ductile mode is enabled in which the process can be progressed in a deformation range of the material without causing the crack in principle.

In addition, the peripheral velocity of the blade 26 with respect to the workpiece W (peripheral velocity of blade) is set to be sufficiently high in comparison with the relative feeding speed of the blade 26 with respect to the workpiece W (feeding speed for machining). For instance, when the rotation number of the blade 26 is 20,000 rpm and the outer diameter of the blade 26 is 50.8 mm, the relative feeding speed of the blade 26 is set at 10 mm/s with respect to the rotational speed of the blade 26 of 53.17 m/s.

Incidentally, the cut depth and the rotational speed of the blade 26, and the relative feeding speed of the blade 26 to the workpiece W are controlled by the controller 24 shown in FIG. 1.

The dicing processes in such a ductile mode are repeatedly performed until the groove depth of the cut line becomes the final cut depth, in the state in which the cut depth per one cut is set at the critical cut depth or less.

When the dicing process along one cut line with respect to the workpiece W has been ended, the blade 26 is indexing-fed to an adjacent cut line to be processed next, and is positioned there. Then, the dicing process along the cut line is performed according to the process procedure which is similar to the above described procedure.

When the above described dicing process has been repeated and all of the dicing processes along the predetermined numbers of the cut lines have been ended, the workpiece W is rotated at 90 degrees together with the worktable 30, and the dicing process along a cut line in a direction perpendicular to the above described cut line is performed according to the process procedure which is similar to the above described procedure.

Thus, when all of the dicing processes along all of the cut lines have been completed, the workpiece W is cut and divided into a large number of chips.

Here, in order to verify the effect of the present invention, results of the grooving process will be described below which have been performed on the workpiece with the use of the blade 26 of the present embodiment and the conventional electroformed blade, according to the above described dicing process method.

Comparative Experiment 1 (Silicon Wafer)

A double-side tapered type (V type on both sides) of the blade 26 was used as the blade 26 of the present embodiment. On the other hand, a blade having a thickness of 50 μm (grain size #600) was used as a conventional electroformed blade. Other conditions are as follow.

Apparatus: blade dicing apparatus AD20T (made by TOKYO SEIMITSU CO., LTD.)
Rotation number of blade: 20,000 rpm
Workpiece feeding speed (feeding speed for machining): 10 mm/s
Cut depth: 30 μm
Workpiece: silicon wafer (with thickness of 780 μm)

Figure 8A:
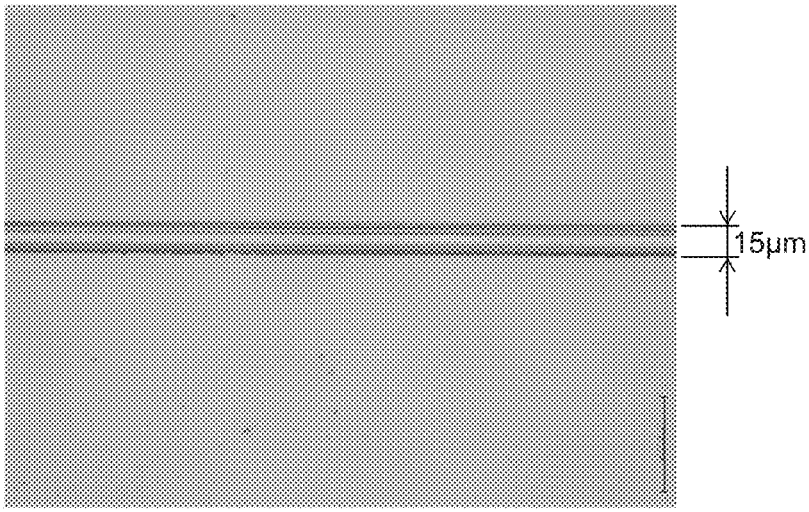
FIG. 8A is a diagram showing a result of Comparative Experiment 1 (grooving process on silicon) (present embodiment).
Figure 8B:
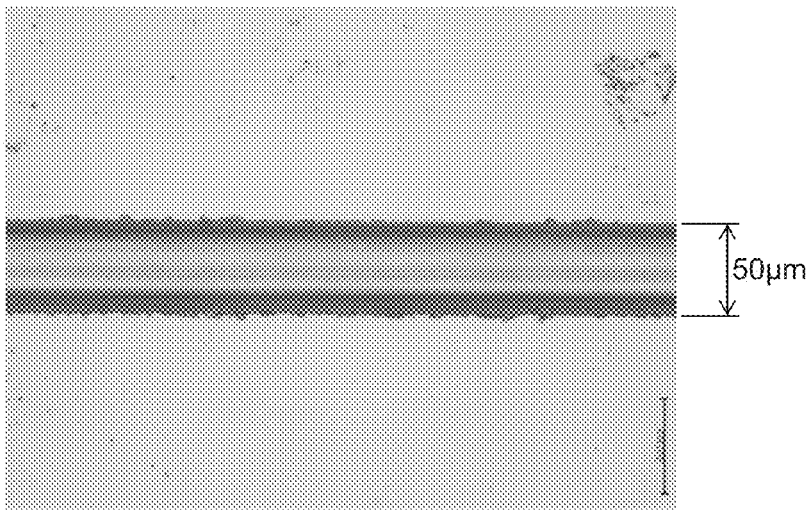
FIG. 8B is a diagram showing a result of Comparative Experiment 1 (grooving process on silicon) (conventional technology).

The result of Comparative Experiment 1 is shown in FIGS. 8A and 8B. Incidentally, FIGS. 8A and 8B each show a state of the surface of the workpiece after having been subjected to the grooving process, according to the present embodiment and the conventional technology.

As is shown in FIG. 8A, when the blade 26 of the present embodiment is used, cracks did not occur in the workpiece, and a cutting groove could be formed.

On the other hand, when the conventional electroformed blade was used, fine cracks occurred on the surface of the workpiece, as is shown in FIG. 8B. In addition, cracks occurred also on the bottom face of the cutting groove.

Thus, it was confirmed that when the blade 26 of the present embodiment was used, the blade did not cause a crack, and could stably perform the cutting process in the ductile mode with high precision, in comparison with the case where the conventional electroformed blade was used.

Comparative Experiment 2 (Sapphire Wafer)

Next, the comparative experiment was performed on the following conditions with the use of similar blades to those in Comparative Experiment 1.

Apparatus: blade dicing apparatus AD20T (made by TOKYO SEIMITSU CO., LTD.)
Rotation number of blade: 20,000 rpm
Workpiece feeding speed (feeding speed for machining): 10 mm/s
Cut depth: 50 μm
Workpiece: sapphire wafer (with thickness of 200 μm)

Figure 9A:
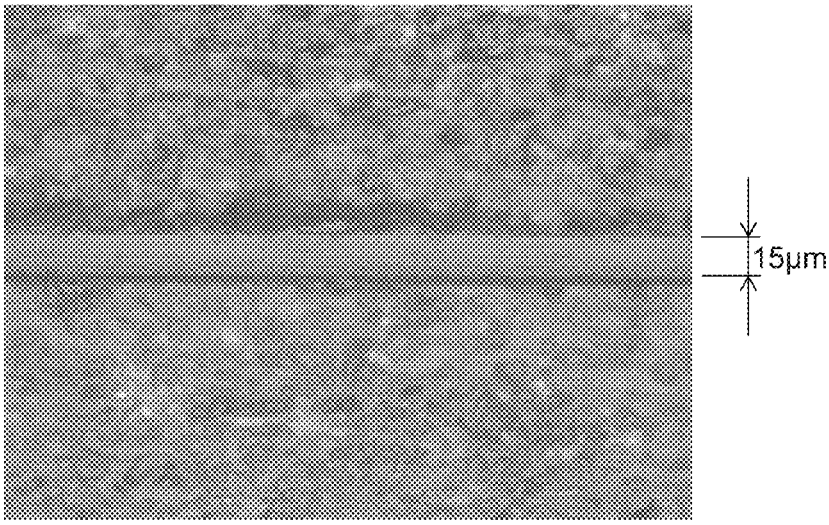
FIG. 9A is a diagram showing a result of Comparative Experiment 2 (grooving process on sapphire) (present embodiment).
Figure 9B:
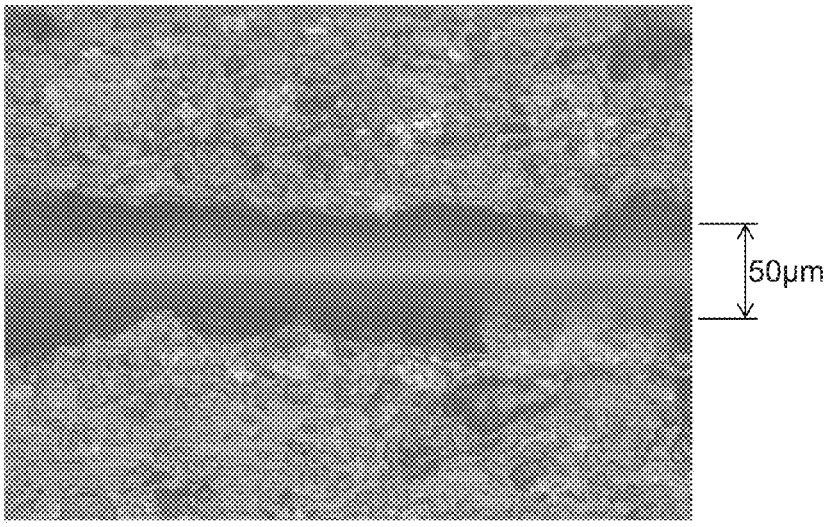
FIG. 9B is a diagram showing a result of Comparative Experiment 2 (grooving process on sapphire) (conventional technology).

The result of the Comparative Experiment 2 is shown in FIGS. 9A and 9B. Incidentally, FIGS. 9A and 9B each show a state of the surface of the workpiece after having been subjected to the grooving process; and FIG. 9A shows the case where the blade 26 of the present embodiment was used, and FIG. 9B shows the case where the conventional electroformed blade was used.

As is clear from FIG. 9A and FIG. 9B, it was confirmed that also when the workpiece was changed to the sapphire wafer, a similar effect to that in Comparative Experiment 1 in which the silicon wafer was an object could be obtained.

Comparative Experiment 3 (SiC Wafer)

Next, the comparative experiment was performed on the following conditions with the use of a straight-shaped blade. The comparative experiment was performed on the condition that the thicknesses of the blades were each 20 μm, 50 μm and 70 μm.

Apparatus: blade dicing apparatus AD20T (made by TOKYO SEIMITSU CO., LTD.)
Rotation number of blade: 20,000 rpm
Workpiece feeding speed (feeding speed for machining): 2 mm/s
Cut depth: 200 μm
Workpiece: 4H—SiC wafer Si face (with thickness of 330 μm)

Figure 10A:
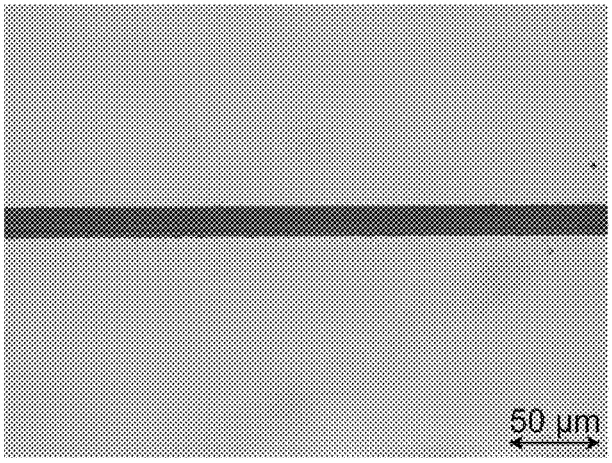
FIG. 10A is a diagram showing a result of Comparative Experiment 3 (case of blade thickness of 20 μm).
Figure 10B:
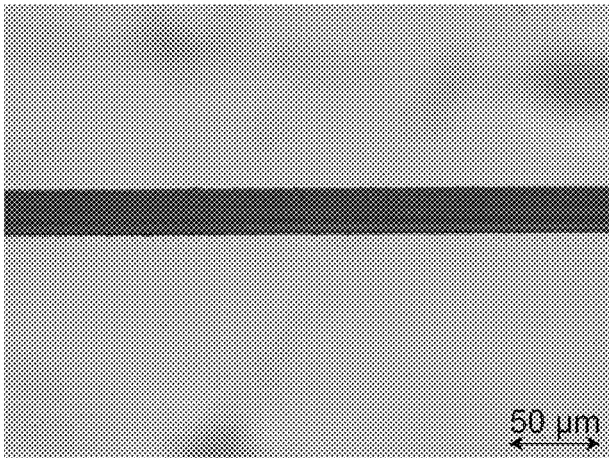
FIG. 10B is a diagram showing a result of Comparative Experiment 3 (case of blade thickness of 50 μm).
Figure 10C:
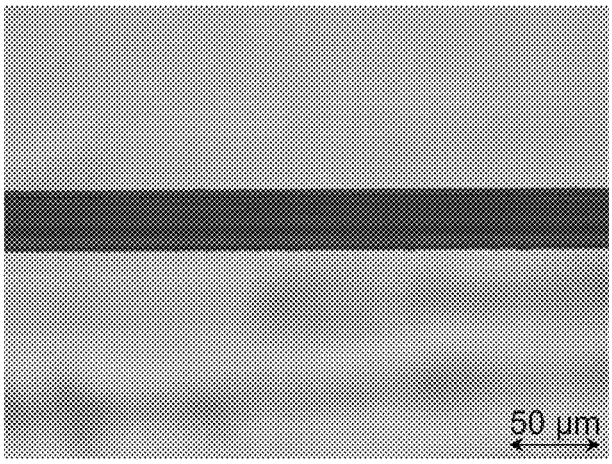
FIG. 10C is a diagram showing a result of Comparative Experiment 3 (case of blade thickness of 70 μm).

FIGS. 10A to 10C each show a state of the surface of the workpiece after having been subjected to the grooving process by the blade 26 of the present embodiment; and FIG. 10A shows the case where the thickness of the blade was 20 μm, FIG. 10B shows the case where the thickness of the blade was 50 μm, and FIG. 10C shows the case where the thickness of the blade was 70 μm.

It is ideal to set the thickness of the blade at 50 μm or less, but in the case of SiC, when the edge thickness was 70 μm, there was no remarkable crack though there were small cracks.

Comparative Experiment 4 (Hard Metal)

Next, the comparative experiment was performed on the following conditions with the use of the straight-shaped blade, similarly to Comparative Experiment 3. The comparative experiment was performed on the condition that the thickness of the blade was 20 μm.

Apparatus: blade dicing apparatus AD20T (made by TOKYO SEIMITSU CO., LTD., AD20T is model number)

Rotation number of blade: 10,000 rpm

Workpiece feeding speed (feeding speed for machining): 1 mm/s

Cut depth: 40 μm

Workpiece: superhard WC (WC: tungsten carbide)

Figure 11A:
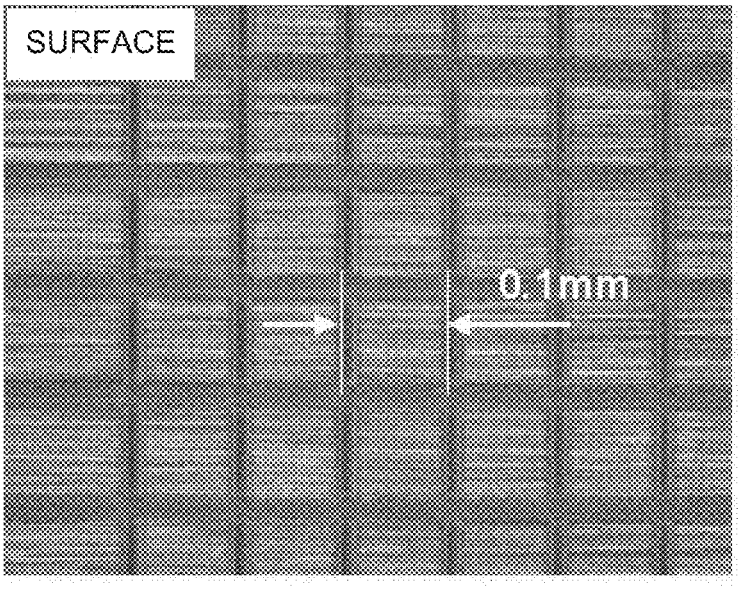
FIG. 11A is a diagram (surface of workpiece) showing a result of Comparative Experiment 4.
Figure 11B:
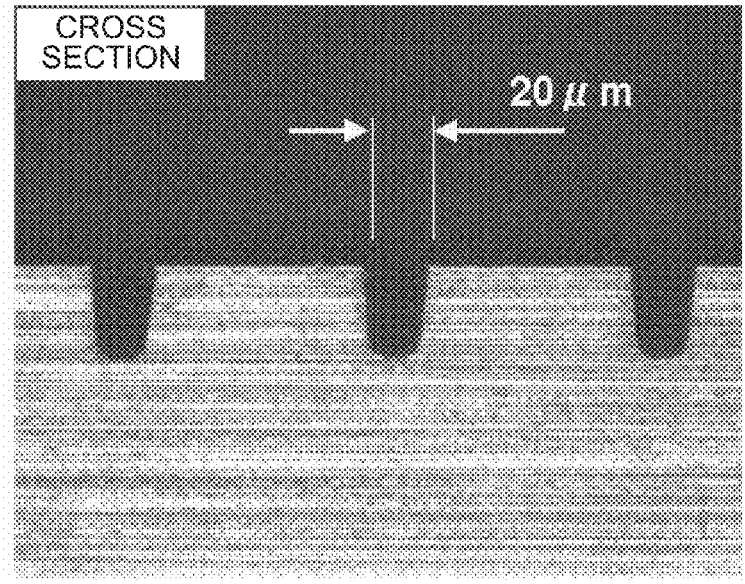
FIG. 11B is a diagram (cross section of workpiece) showing a result of Comparative Experiment 4.

FIGS. 11A and 11B show the states of the surface (FIG. 11A) of the workpiece and the cross section (FIG. 11B) of the workpiece after having been subjected to the grooving process by the blade 26 of the present embodiment, respectively. As in the figure, it is shown that an ideal process in a ductile mode can be performed even on a hard material such as the hard metal.

Comparative Experiment 5 (Polycarbonate)

Next, the comparative experiment was performed on the following conditions with the use of the straight-shaped blade, similarly to Comparative Experiment 4. The comparative experiment was performed on the condition that the thickness of the blade was 50 μm.

Apparatus: blade dicing apparatus AD20T (made by TOKYO SEIMITSU CO., LTD.)

Rotation number of blade: 20,000 rpm

Workpiece feeding speed (feeding speed for machining): 1 mm/s

Cut depth: 500 μm (full cut)

Workpiece: polycarbonate

Figure 12A:
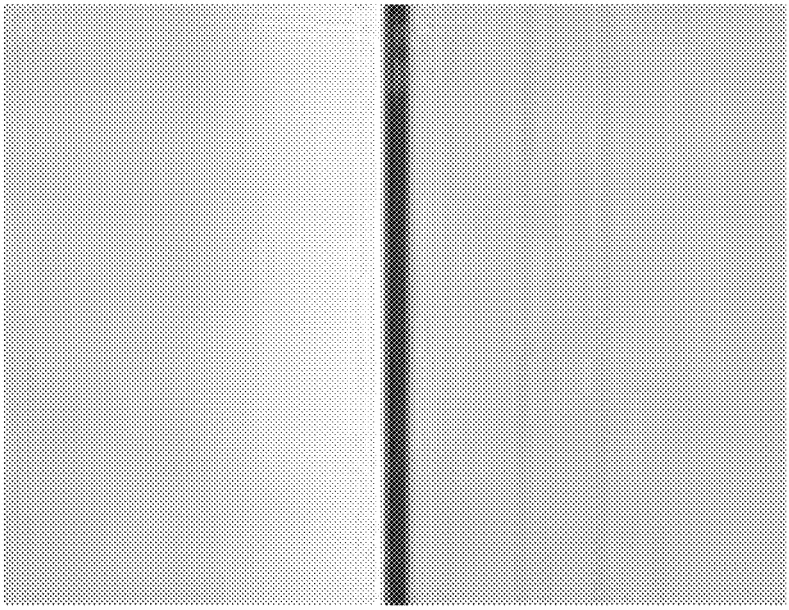
FIG. 12A is a diagram (surface of workpiece) showing a result of Comparative Experiment 5.
Figure 12B:
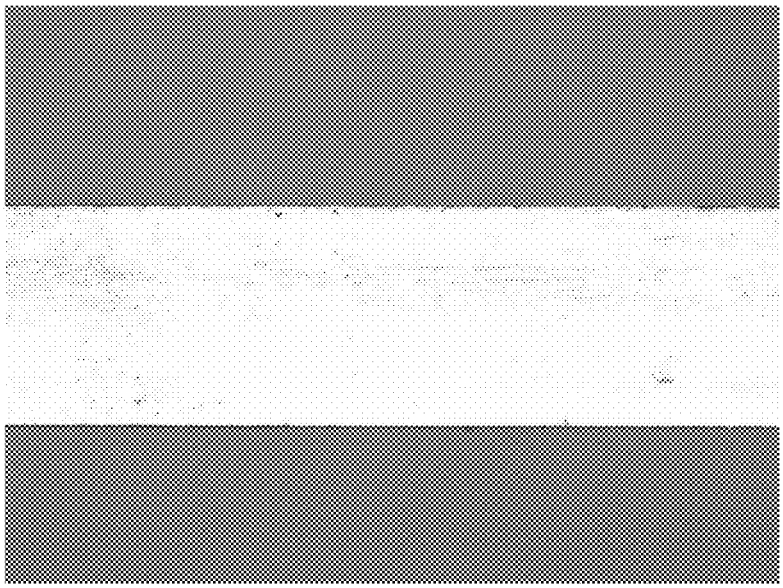
FIG. 12B is a diagram (cross section of workpiece) showing a result of Comparative Experiment 5.

FIGS. 12A and 12B show the states of the surface of the workpiece and the cross section of the workpiece after having been subjected to the grooving process by the blade 26 of the present embodiment, respectively. As is shown in FIG. 12A, a sharp cut line is observed when viewed from the surface of the workpiece. As is shown in FIG. 12B, it is understood that a mirror-finished cut surface is obtained even when having been compared to the conventional electroformed blade.

Comparative Experiment 6 (CFRP: Carbon-Fiber-Reinforced Plastic)

Next, the comparative experiment was performed on the following conditions with the use of the straight-shaped blade, similarly to Comparative Experiment 5. The comparative experiment was performed on the condition that the thickness of the blade was 50 μm.

Apparatus: blade dicing apparatus AD20T (made by TOKYO SEIMITSU CO., LTD.)

Rotation number of blade: 20,000 rpm

Workpiece feeding speed (feeding speed for machining): 1 mm/s

Cut depth: 500 μm (full cut)

Workpiece: CFRP

Figure 13A:
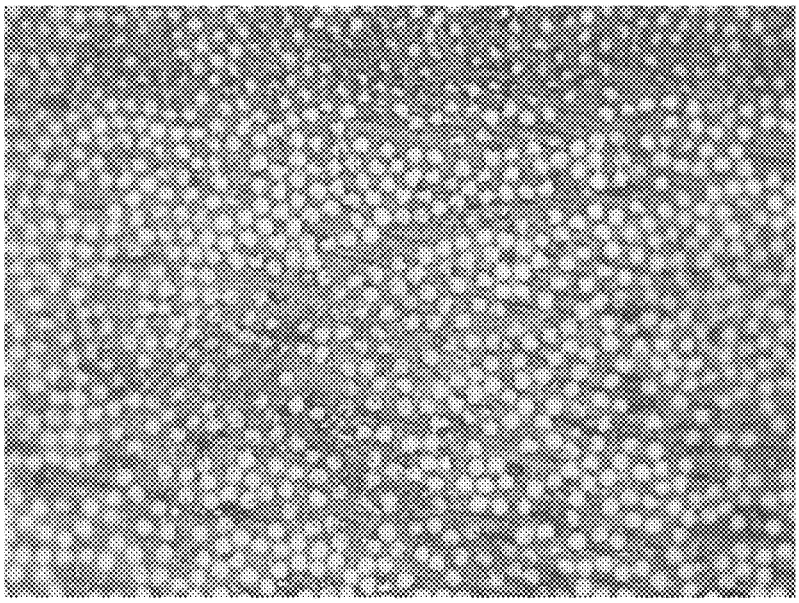
FIG. 13A is a diagram showing a result of Comparative Experiment 6 (present embodiment).
Figure 13B:
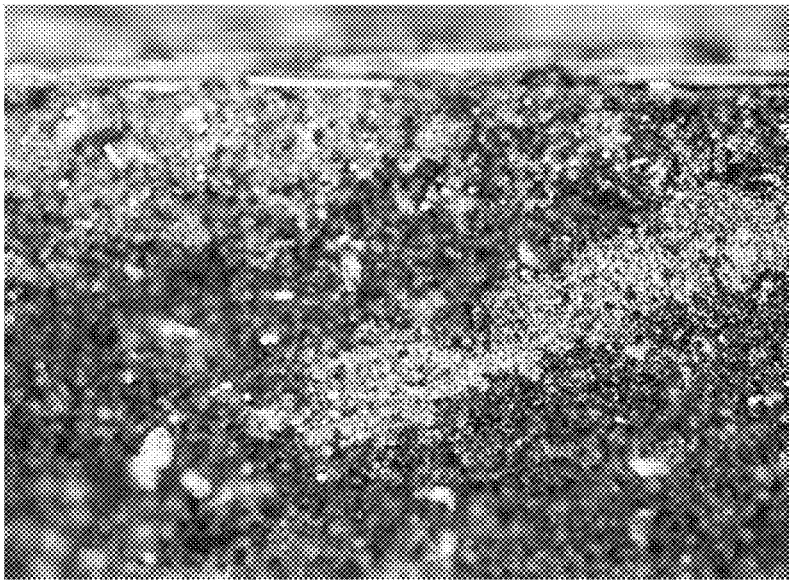
FIG. 13B is a diagram showing a result of Comparative Experiment 6 (conventional technology).

The result of Comparative Experiment 6 is shown in FIGS. 13A and 13B. Incidentally, FIGS. 13A and 13B each show a state of the surface of the workpiece after having been subjected to the grooving process; and FIG. 13A shows the case where the blade 26 of the present embodiment was used, and FIG. 13B shows the case where the conventional electroformed blade was used.

In comparison with the conventional electroformed blade, the electroformed blade tears off each fiber, and accordingly a clean cross section of the fiber cannot be observed. However, in the case of the blade of the present application, the fibers are not entangled and each of the fibers is not torn off; and the cut surface having a sharp end face of the fiber can be obtained.

This result occurs by the following reason. In the case of the blade of the present application, the continuous cutting edges are formed, and each of the recessed portions becomes the cutting edge; and also the diamonds are bonded to each other. Because of this, the cutting edge in the blade of the present application does not absorb the instantaneous shock and sharply functions due to the shear stress of the diamond, though the cutting edge of the electroformed blade does not sharply function when cutting one fiber, because the soft bonding material absorbs the shock.

Next, the reason will be described why the practical dicing process can be performed even when the cutting process is performed in the ductile process mode on the condition that the cut depth of the blade 26 for the workpiece W is set at the critical cut depth (Dc value) or less.

For instance, let us consider such a case that the workpiece W formed of the silicon wafer is subjected to the cutting process with the use of the blade 26 having an outer diameter of 50 mm. Incidentally, the cutting edges (fine cutting edge) formed along the crystal grain boundaries shall be provided along the circumferential direction at approximately 10 μm pitch, on the outer peripheral end part of the blade. In this case, the length of the outer circumference of the blade is 157 mm (157,000 μm), and accordingly approximately 15,700 cutting edges are formed on the outer circumferential part.

Firstly, suppose that a cut of 0.15 μm has been entered as a cut of such a degree that one cutting edge does not give a crack to the workpiece W, and that an amount of the workpiece to be removed by one time of the cut is 0.02 μm (20 nm). Incidentally, the critical cut depth which does not cause a crack in SiC, Si, sapphire, $SiO_2$ and the like is usually a sub-micron order (for instance, approximately 0.15 μm). Then, because there exist 15,700 cutting edges on the outer peripheral end part of the blade, the blade can progress the process theoretically of approximately 0.314 mm (314 μm) per one rotation of the blade. When the spindle of the dicing process is determined to be 10,000 rpm, the spindle rotates 166 times per second. Therefore, the distance in which the outer peripheral end part of the blade advances while cutting, removing and discharging the workpiece per second is 52.124 mm. For instance, when the feeding speed of the blade is set at 20 mm/s, the speed of machining and removing the workpiece material in a shear direction is faster than the speed of advancing in the workpiece material while pressing the workpiece material. Specifically, when the blade cuts the workpiece material, the blade takes a form of making a fine cut of such a degree as not to cause a fracture in the workpiece material on the workpiece material, machining the workpiece material in a horizontal direction perpendicular to the traveling direction of the blade and sweeping the worked workpiece material, and advancing in the swept and removed portion. Because of this, there is not a space into which the blade makes a cut of 0.1 μm or more of such a degree that the crack occurs, and accordingly the blade can perform the cutting process in the ductile process region based on the plastic deformation, without causing the brittle fracture. Specifically, by setting the peripheral velocity of the outer peripheral end part (tip part) of the blade which works a material to be worked by the rotation of the blade while rotating the blade at high speed so as to be large in comparison with the feeding speed of the blade with respect to the material to be worked, it becomes possible to perform the ductile process.

For information, practically, the process is performed with a slight allowance in consideration of some eccentricity of the blade. Specifically, when the blade diameter is ϕ50.8 mm and if the blade machines the material at a feeding speed of approximately 10 mm/s while being rotated at 20,000 rpm, the crack does not occur in the material.

Next, a result of having made various investigations so as to achieve the process in the ductile mode with the use of the blade 26 of the present embodiment will be described below.

[Relationship Between Particle Size and Content of Diamond Abrasive Grain]

In the present embodiment, in order that the blade 26 performs process in the ductile mode, the arrangement of the abrasive grains in the circumferential direction of the blade 26 needs to be considered. The reason is as follows.

Firstly, suppose that the blade enters the cut of 0.15 μm. In order to do so, the cutting edge (fine cutting edge) for entering the cut desirably has such sizes of the abrasive grain and an interval between the cutting edges as to be larger than 0.15 μm by approximately one order. When the interval between the cutting edges is larger than 0.15 μm by three or more orders, it is difficult to enter a fine cut, when considering also the dispersion of the intervals between the cutting edges.

Figure 14:
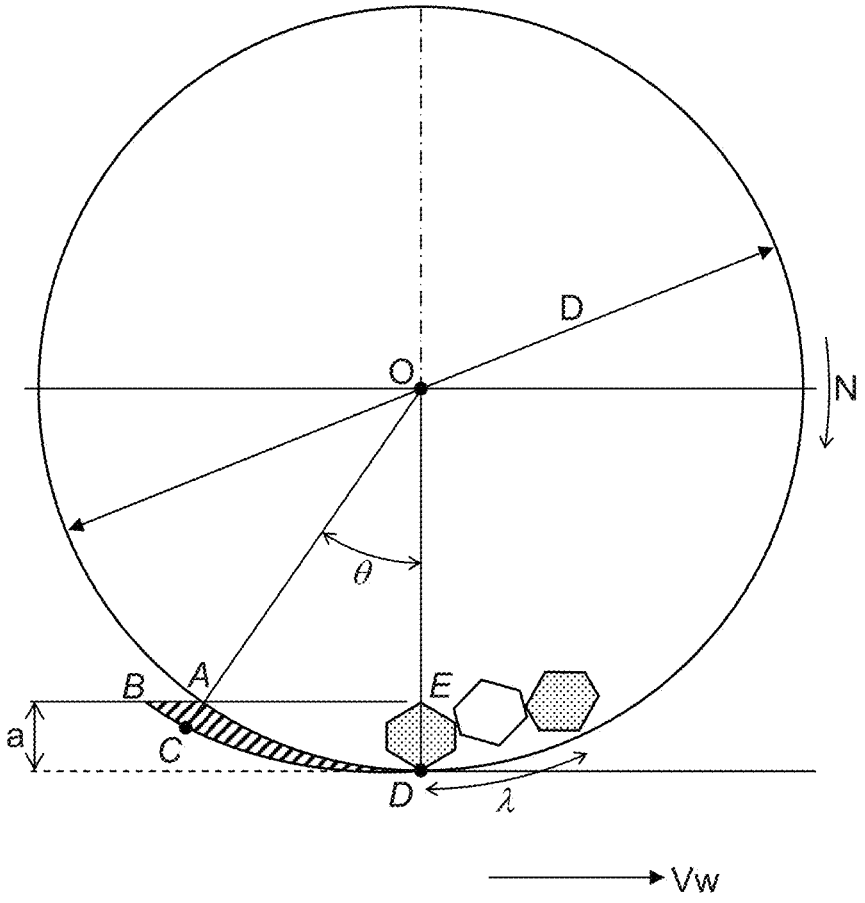
FIG. 14 is an explanatory diagram in the case where the maximum cut depth when the blade parallelly moves to machine the workpiece while is geometrically calculated.

Generally, a maximum cut depth will be geometrically calculated, the maximum cut depth when the blade having the cutting edges which are arranged at approximately even intervals machines the tabular sample while being moved in parallel to the tabular sample. When a hatched portion is hereafter assumed to be swarf portion per one edge with reference to FIG. 14, a length AC which is determined by a line that connects the center O of the blade with one point A on the swarf becomes the maximum cut depth $g_{max}$ per one edge.

Incidentally, D shall represent a diameter of the blade, Z shall represent the number of the cutting edges of the blade, N shall represent the number of revolutions of the blade per minute, $V_s$ shall represent a circumferential velocity (πDN) of the blade, Vw shall represent the feeding speed for the workpiece, Sz shall represent the feeding amount per one edge of the blade, and a shall represent the cut depth.

Then, suppose that the angle is expressed by the following expression, $$\angle AOD = \theta \quad \text{[Expression 1]}$$

and suppose that the cut depth $g_{max}$ is sufficiently small in comparison with the diameter D of the blade. Then, the following expressions hold.

$$g_{max} = \overline{AC} = \overline{AB}\sin\theta \quad \text{[Expression 2]}$$

$$\overline{AB} = S_z = V_w / NZ \quad \text{[Expression 3]}$$

$$\begin{aligned}\sin\theta &= AE / OA \\ &= \sqrt{aD} \Big/ \frac{D}{2} \\ &= 2\sqrt{a/D}\end{aligned} \quad \text{[Expression 4]}$$

Therefore, $$g_{max} = 2\frac{V_w}{NZ}\sqrt{\frac{a}{D}} \quad \text{[Expression 5]}$$

Here, the interval λ between the cutting edges shall be used instead of the number Z of the edges of the blade, and Z=πD/λ shall hold. When the equation is substituted into Expression (1), the maximum cut depth per one edge is determined as follows.

$$g_{max} = 2\frac{V_w}{\pi DN}\lambda\sqrt{\frac{a}{D}} \quad \text{[Expression 6]}$$

Here, πDN is clearly equal to the peripheral velocity $V_s$ of the blade. Specifically, in the machining for a flat plate by the blade, a relationship between the interval λ between the cutting edges and the maximum cut depth per one edge is given by the following expression.

$$g_{max} \approx 2\lambda\frac{V_\omega}{V_s}\sqrt{\frac{a}{D}}, \quad \text{[Expression 7]}$$

wherein $g_{max}$ is a cut depth per unit of cutting edges, λ is an interval between cutting edges, $V_\omega$ is a workpiece feeding speed, $V_s$ is a speed of a blade, a is a cut depth of the blade, and D is a blade diameter.

From the above expression, it is understood that the interval between the cutting edges becomes important, in order to control the cut depth per unit of the cutting edges to a constant value or less. In addition, the rotational speed of the blade also becomes important.

According to the relationship shown in Expression (1), even though $V_\omega$ is set at 40 mm/s, $V_s$ is set at 26,166 mm/s, a is set at 1 mm, D is set at 50 mm, and λ is set at 25 μm, the cut amount is only a level of 0.027 μm, and becomes the cut amount of 0.1 μm or less. If the process being in this range, the cut amount is the critical cut depth or less, and accordingly the process is in a range of the process in the ductile mode.

In order to perform the process in the ductile mode, the above described conditions must be surely satisfied.

Furthermore, suppose that a thickness of the workpiece is set at 0.5 mm, a feeding speed of the workpiece is set at 10 mm/s, and the interval between the cutting edges in the outer circumferential portion of the blade is formed at a pitch of 1 mm ($V_\omega$: 10 mm/s, $V_s$: $157\times10^4$ mm/s, a: 0.5 mm, D: 50 mm, and λ: 1 mm), on the condition that a blade having a diameter of 2 inch (diameter of 50 mm) rotates at 10,000 rpm and machines a workpiece, as practical conditions.

Even in the conditions, if the values are substituted into the above expression, the critical cut depth which one edge enters becomes 0.08 μm, and still becomes a cut depth of 0.1 μm or less. Therefore, in the case where it is assumed that the blade is not decentered and all of the cutting edges ideally function for a removal process for the workpiece, if the interval between the cutting edges which can be formed on the outer circumferential part of the blade is critically 1 mm or less, it becomes possible to progress the process without giving an excessive cut which causes a fatal crack to the workpiece.

In addition, in the SiC, the critical cut depth which does not cause the crack is approximately 0.1 μm, but in other materials of sapphire, glass, silicon and the like, the critical cut depth which does not cause the crack is approximately 0.2 to 0.5μ, and accordingly when the critical cut depth is set at 0.1 μm or less, most of the brittle materials do not cause the crack therein, and the process can be performed in the plastic deformation region of the material. Therefore, it is desirable that the interval between the cutting edges to be provided on the periphery of the blade is 1 mm or less.

On the other hand, it is better that the interval between the cutting edges in the periphery of the blade is 1 μm or more.

If the average interval between the cutting edges is 1 μm or less, in other words, when the blade has the interval between the cutting edges of a sub-micron order, the amount of the critical cut depth and the unit of the depth of the material removal become approximately the same level. Specifically, both of the amount and the unit become the sub-micron order, but on such a condition, it is actually difficult that one cutting edge reaches the expected removal amount, and on the contrary, the process speed rapidly decreases due to a clogging mode.

Under such a situation, it is thought that aside from the critical cut depth of one cutting edge, the depth to be removed by one cutting edge is unreasonable.

Note that, the above described thought holds true when the cross-sectional area at which the workpiece is cut is constant. Specifically, the thought coincides with the content concerning an approximately tabular sample and a blade which rotates at high speed, is set so that the cut depth of the blade is a certain cut depth with respect to the tabular workpiece, and performs cutting process on the workpiece while the workpiece is being slid.

In addition, the above described expression also shows that the critical cut depth given by one cutting edge depends on the interval between the cutting edges, which is important. The amount to be cut by one cutting edge affects the interval between the present cutting edge and the next cutting edge, and shows a possibility that the cutting edge enters a deeper cut than the desired critical cut depth into the workpiece to cause the crack, when there is a portion in which the interval between the cutting edges is large. Therefore, the interval between the cutting edges is an important factor, and in order to obtain a stable interval between the cutting edges, a PCD material formed by sintering the single crystal diamonds is preferably used so that the interval between the cutting edges is naturally set from the composition of the material.

However, even if the particle size (average particle size) of the diamond abrasive grains is large, as long as the grains are densely spread in the gaps and the substantial interval between the abrasive grains has a smaller order than that of the particle size, it becomes possible to further suppress and control the cut of the abrasive grains. Actually, the diamond abrasive grains have a particle size desirably of approximately 1 μm to 5 μm as an ideal particle size.

In addition, the particle size does not necessarily become the interval between the cutting edges. In the case where the blade is subjected to highly precise truing, the interval between the cutting edges may correspond to the particle size, but usually, in the state in which the blade is cut and dressed, the interval between the cutting edges becomes larger than the particle size of the abrasive grains.

Specifically, if the particle size is strictly specified by the grain boundary, it is interpreted that the gaps existing on both sides of one abrasive grain correspond to the cutting edge, but actually some abrasive grains fall off in a lump form, and the voids naturally form cutting edges at constant periodicity. Thus, the pitch of the cutting edges can be formed by uniformly roughening the blade.

Figure 15A:
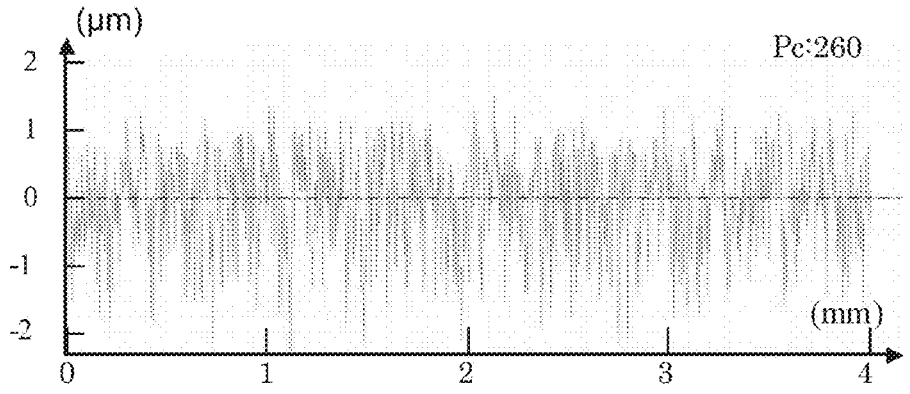
FIG. 15A is a diagram showing a result obtained by having measured the outer peripheral end of the blade with a roughness meter.
Figure 15B:
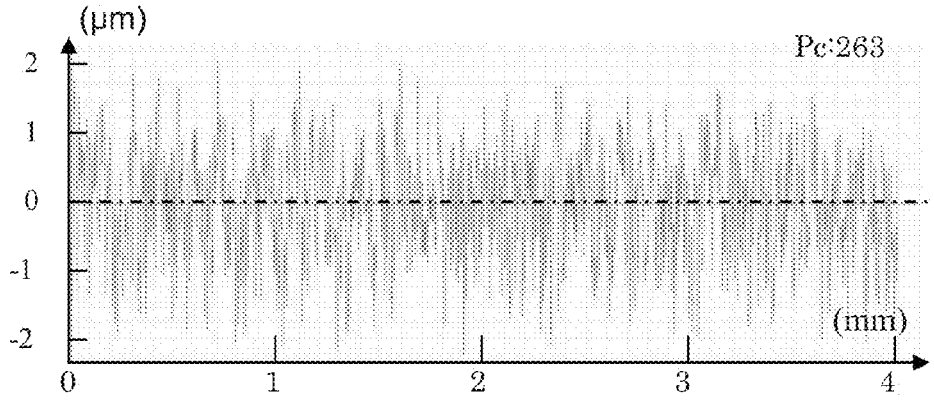
FIG. 15B is a diagram showing a result obtained by having measured the outer peripheral end of the blade with the roughness meter.
Figure 16A:
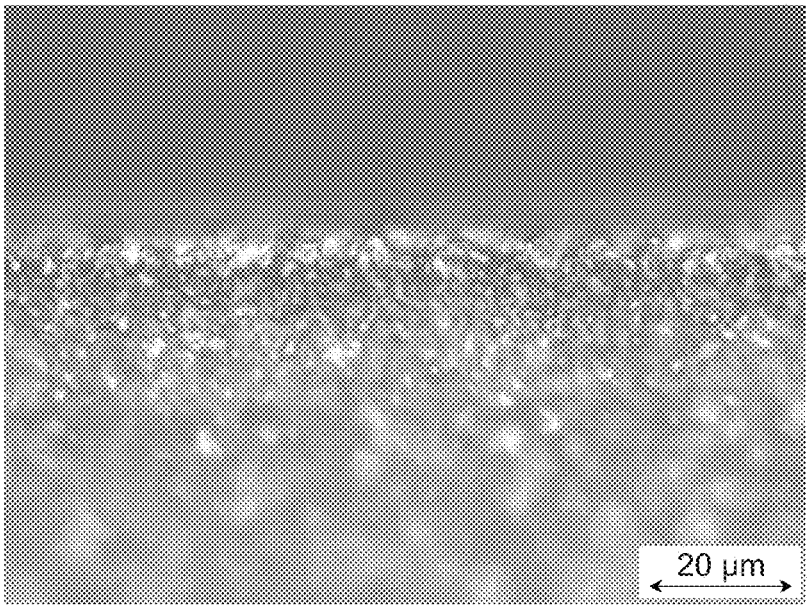
FIG. 16A is a diagram showing the surface state of the outer peripheral end of the blade (side face of tip of blade).
Figure 16B:
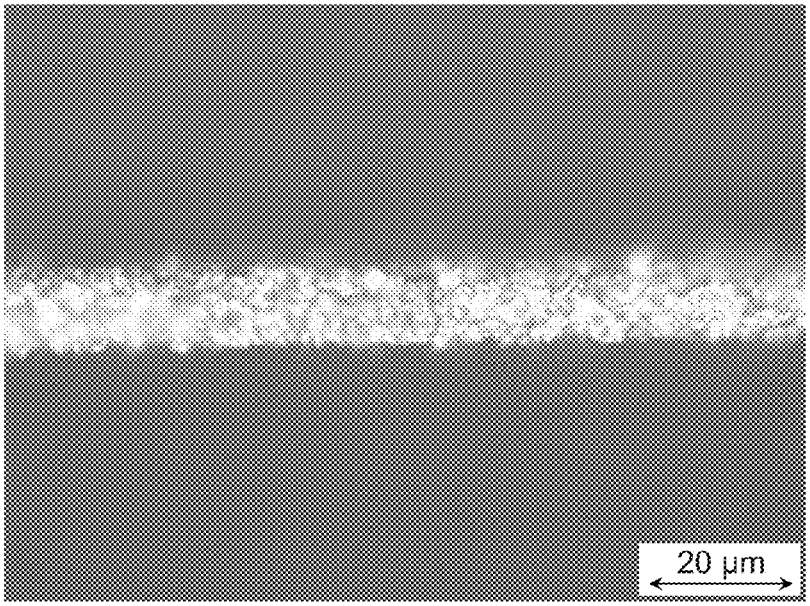
FIG. 16B is a diagram showing the surface state of the outer peripheral end of the blade (tip of blade).

FIGS. 15A and 15B show a result obtained by having measured the outer peripheral end of the blade with a roughness meter. Furthermore, FIGS. 16A and 16B show photographs of the surface state. Because the blade is the sintered body, all of portions which are viewed on the surface are basically formed of the diamonds that are abrasive grains.

In addition, the convexoconcaves of the surface is formed of the diamond grain boundaries, and the uneven shapes having naturally approximately even intervals are formed. Each of the recessed parts functions as a cutting edge for entering the cut into the material. As for this pitch of the cutting edges, as is clear from the figures, there are 260 peaks and 263 peaks with a range of 4 mm, and accordingly it is understood that the interval between the cutting edges corresponds to a pitch of approximately 15 μm. In addition, the present material is formed of DA 200 made by SUMITOMO ELECTRIC HARDMETAL CORP., and the particle size of the constituting diamond particles is nominally 1 μm. Thus, even though the particle size is small, the interval between the cutting edges is formed so as to be larger than the particle size, and is formed so as to be an approximately even interval, as is understood from the figures.

Such cutting edges at the even intervals are formed because the blade itself is formed of the diamond sintered body which is formed by sintering the fine particles of the single crystal.

Thus, the tip portion of the blade has convexoconcaves largely formed, in order to progressively cut into the workpiece, but in contrast to this, the side face portion of the blade grinds the workpiece so that the end face of the workpiece after having been subjected to the cutting process and having been removed has a mirror-finished surface, in comparison with the tip portion of the blade. Because of this, the tip part of the blade is roughly formed so as to progressively cut into the workpiece, and in contrast to this, the side face part of the blade is finely formed.

Incidentally, in the conventional electroformed blade, usually, the interval between the diamond abrasive grains is remarkably large in comparison with the particle size. This is because the diamond abrasive grains which are sparsely scattered are simply plated, and the intervals are completely different at the time when the grains are plated.

In contrast to this, in the blade 26 of the present embodiment, because a sintering aid is melted by sintering, diffuses into the diamond and strongly bonds the diamonds to each other, the diamond sintered body is formed to be extremely hard and have high strength. In addition, the diamond sintered body has a relatively large content of the diamond in comparison with that of the electroformed blade, (for instance, see Japanese Patent Application Laid-Open No. 61-104045), and has relatively a high strength in comparison with the electroformed blade.

In addition, many parts in the inside of the blade material are occupied by the diamond, and accordingly the volume of other parts (including sintering aid) than the diamond can be made smaller than the volume of the diamond; and in the case of the diamond sintered body, even if the particle size is large, the gap between the diamond particle sizes can be substantially controlled to a size of a micron order.

In addition, the recessed portion between the diamond abrasive grains plays an extremely important role in the present invention. The diamond abrasive grains are extremely hard. However, a part of cobalt which is contained as the sintering aid permeates into the diamond, but a part thereof remains between the diamond abrasive grains. This portion is slightly soft in comparison with the diamond, accordingly is easily worn in the cutting process, and is formed into a slightly recessed shape. Specifically, there is a portion sandwiched between the diamonds, and the recess therebetween is formed into a fine cutting edge. Thereby, the blade is intended to provide a stable cut without giving an excessive cut to the workpiece. In addition, the fine cutting edge is not only formed of the recess sandwiched between the diamonds, but also the recessed portion which has been formed by missing of the diamond abrasive grain itself occasionally works as the cutting edge. This interval between the cutting edges may be set at an interval in such a degree as not to exceed the critical cut depth per one edge shown in the above expression.

For instance, the case will be considered where the diamond abrasive grains having a particle size of 25 μm are fixed by sintering. Here, in order to facilitate the description, it shall be assumed that the diamond abrasive grain is a cube with a 25 mm square. In order to bond the diamond abrasive grains to each other, portions of 1 μm on both sides on the outside of 25 μm shall be used as a bonding portion for being bonded to other particles. Then, the diamond abrasive grain becomes a cube with 27 μm square. In this case, the volume percentage which is occupied by the portion of the diamond abrasive grains becomes approximately 78.6%. Therefore, if the blade has approximately 80 volume % (vol %) or more of the content of the diamond, even in the case of the diamond abrasive grains having the particle size of 25 μm, the gap between the diamond abrasive grains, specifically, the interval between the particles becomes substantially 1 to 2 μm at most, and the recessed portion becomes the cutting edge (fine cutting edge) for giving the cut to the workpiece. In addition, if the interval between the particles is approximately 2 μm, even when the particles arranged at the pitch are pressed into the workpiece material in the interval between the particles, the displacement of the workpiece material becomes smaller by one order or more in comparison with the interval between the diamond abrasive grains.

Specifically, the displacement becomes equal to or less than 0.15 μm. In addition, suppose that the cutting edges (fine cutting edges) are formed at a pitch of 25 μm. In the case where the blade diameter is 50 mm, 6,280 pieces of the cutting edges are formed per whole perimeter of approximately 157 mm. If the blade is rotated at 20,000 rpm, 2,093,333 pieces of cutting edges can function per second.

Suppose that this one cutting edge enters a cut of 0.15 μm or less into the workpiece, and removes approximately 0.03 μm which is ⅕ of the 0.15 μm per second. Then, if there are 2,093,333 pieces of the fine cutting edges, the fine cutting edges are capable of removing 62,799 μm per second, and can theoretically progressively cut into the workpiece approximately 6 cm per second.

From such a point as well, theoretically, even if the diamond abrasive grains have a particle size of 25 μm, as long as the blade has 80% or more of the content of the diamond, a portion of the gap between the diamond abrasive grains which are bonded to each other becomes approximately 1 to 2 μm, and as a result, the blade can give the cut amount of 0.15 μm to the workpiece as a stable cut amount, without giving the excessive cut amount to the workpiece.

In addition, even when the particle size of the diamond abrasive grains is not 25 μm but less than 25 μm, if the content of the diamond is controlled to 80% or more, there is no problem because the values do not exceed the critical cut depth in the points of the cut and the material removal amount, and it becomes possible to perform the process in the ductile mode without causing the crack.

As has been described above, in the case of the diamond sintered body, the diamond abrasive grains (diamond particles) are densely packed, accordingly the content of the diamond is extremely high, and each of the diamond abrasive grains works as the cutting edge having the size of the diamond abrasive grain.

In addition, the distance between the diamond abrasive grains becomes remarkably small in comparison with the particle size of the diamond abrasive grains, and it becomes possible to precisely control the cut amount. As a result, the cut depth does not become larger than a predetermined cut depth which has been originally intended, and the stable cut depth is always ensured during the work. As a result, it becomes possible to perform the cutting process in the ductile mode without failure.

Incidentally, when the particle size is as large as approximately 25 μm, the content of the diamond abrasive grains can be further increased. In the products which are available in the market, there is a product having approximately 93% of the content (content of diamond). If so, a ratio of the sintering aid is further decreased, in other words, the gap between the diamond abrasive grains becomes actually minute.

However, when the diamond having the large particle size of 25 μm or more is used, as has been described above, the particle size is sufficient in the point of the interval between the cutting edges when the process in the ductile mode is performed, but on the other hand, when the edge thickness of the blade is set at 50 μm or less, the cutting edge cannot be manufactured from such large abrasive grains.

This is because when the cutting edge is manufactured so as to have an edge thickness of 40 μm, for instance, the blade must contain at least two or more diamond abrasive grains in the cross section of the blade, but two diamond abrasive grains do not theoretically enter the cross section but 1.6 diamond abrasive grains enter.

[Edge Thickness of Blade in Consideration of Deformation of Workpiece Material]

In order to stably perform the process in the ductile mode, the cut in a depth direction needs to be controlled to approximately 0.15 μm or less, as has been described above. In order that this cut is stably performed, the displacement in the thickness direction (displacement in vertical direction) of the workpiece material, which is considered from the cut width, also needs to be considered.

Specifically, when the cut is entered into the workpiece in a wide range in a direction parallel to the blade surface (plane perpendicular to rotation axis of blade 26) and removes the workpiece, the deformation of the workpiece material caused by the cutting and the removal expands also in the vertical direction (cut depth direction). Specifically, when the Poisson's ratio of the workpiece material is taken into consideration, the cut width needs to be set at a value limited to some extent. The reason is because when the cut depth is made extremely large, an aftereffect of the deformation affects the material also in the vertical direction due to the deformation of the material caused by the influence of the Poisson's ratio. Thereby, the cut amount having a predetermined critical cut depth which has been set or more enters into the workpiece, and as a result, occasionally induces the cracking of the workpiece W.

Here, the edge thickness (width of blade) of the blade will be investigated, which can stably give the cut to the workpiece when the influence of the Poisson's ratio is taken into consideration. Table 4 shows a relationship between the Young's modulus of a brittle material and the Poisson's ratio.

TABLE 4

| Workpiece material | Young's modulus [Gpa] | Poisson's ratio |
|---|---|---|
| Silicon | 130 | 0.177 |
| Quartz | 76.5 | 0.17 |
| Sapphire | 335 | 0.25 |
| SiC | 450 | 0.17 |

Here, one cutting edge shall enter into the workpiece material. In addition, suppose that the cross-sectional shape of the tip of a thin straight blade is not particularly arbitrarily sharpened, but becomes a substantially semicircular shape, while the blade is continued to be used for the work.

In such a case, suppose that a substance having a rectangular solid gives the cut of 0.15 μm to the workpiece, for instance, and that the substance parallelly gives a cut having a width of approximately 1 μm to the workpiece. Then, according to the Poisson's ratio, the workpiece cause displacement in the vertical direction simply by approximately 0.17 μm in association with the cutting. This value is close to the actual cut amount. Actually, the influence of the Poisson's ratio is given not only to the vertical displacement but also the displacement in a horizontal direction, and accordingly as long as the width is approximately 1 μm, the cut amount having the width can be given to the workpiece.

Figure 17:
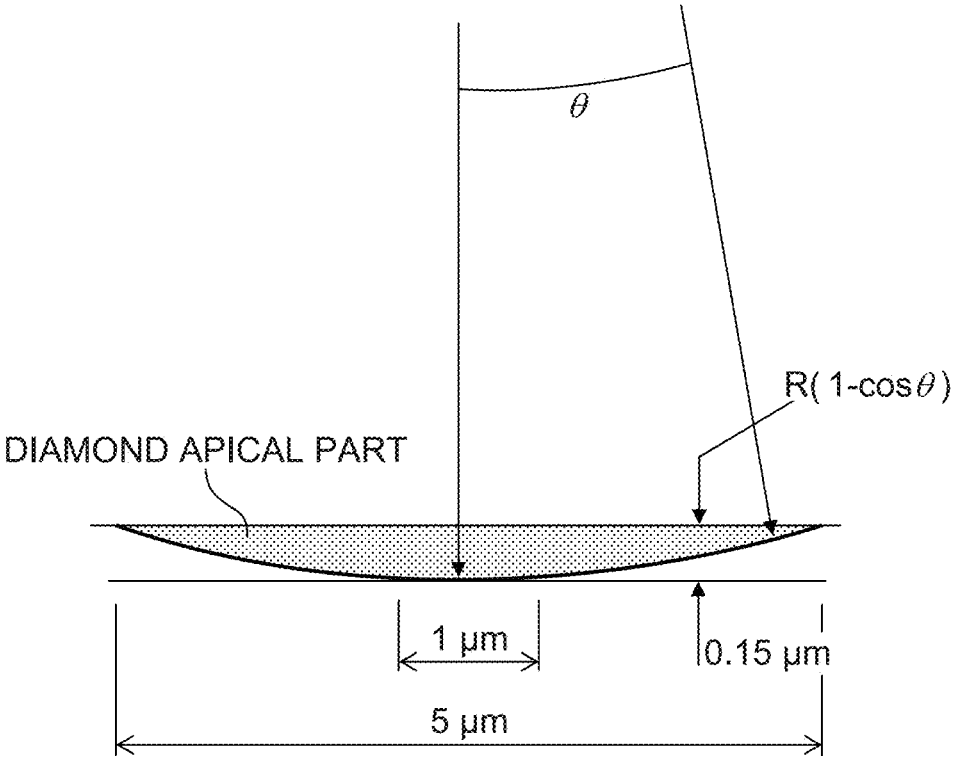
FIG. 17 is a schematic diagram showing a state in which the tip of the blade cuts the workpiece material.

However, as is shown in FIG. 17, when the approximately semicircle-shaped tip of the blade (outer peripheral end part of blade) cuts the workpiece material to the depth of 0.15 μm, the cut width is not made uniformly in the workpiece material parallel in the width direction. Accordingly, when the rising of the outer circumference is taken in consideration, as long as the tip has the arc-shaped width of approximately 5 μm, the tip portion can cut the workpiece material without being affected by the Poisson's ratio. Specifically, a relationship of R sin θ=2.5 holds, and a relationship of R(1−cos θ)=0.15 holds.

If these relationships are calculated backward, the radius of the blade in the tip portion becomes approximately 25 μm, and a vertex angle which gives the above described cut having a width of 5 μm becomes approximately 12 degrees.

Therefore, the width of the blade which cuts into the material needs to be controlled to be approximately 50 μm or less at most. When the width is more than 50 μm, the blade works on the material simultaneously planarly on each of the points, which occasionally leads to induce the fine crack.

For information, if the curvature is larger than the above value, in other words, the thickness of the blade is approximately 30 μm, the cutting edge basically works more locally than in the above described state. Accordingly, the horizontal width of the cutting edge does not basically affect the cut depth, and the blade can stably cut the workpiece.

Incidentally, as for the width of the blade, there is a viewpoint of performing the process in the ductile mode, but the width of the blade largely relates also to a buckling strength of a single body of the blade.

The above described width of the blade receives restriction also from the thickness of the workpiece.

Here, a relationship between the width of the blade and the thickness of the workpiece will be shown.

Figure 18A:
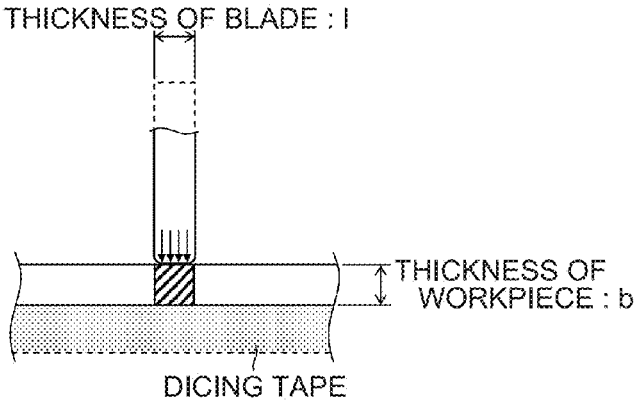
FIG. 18A is an explanatory diagram which is used in the description concerning the thickness of the blade.

The workpiece is generally supported by a dicing tape. The dicing tape is an elastic body, accordingly is different from a hard material such as the workpiece, and tends to easily cause displacement in the vertical direction (Z direction) by a small stress. Here, when the blade cuts the workpiece, the cross-sectional shape of a portion to be cut in the workpiece becomes important, in other words, a shaded portion shown in FIG. 18A becomes important.

Figure 18B:
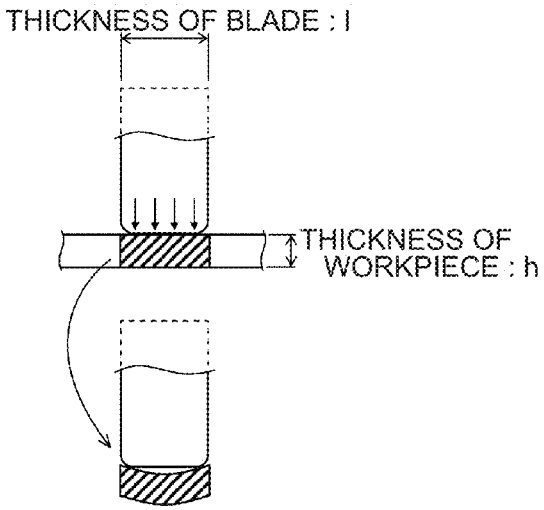
FIG. 18B is an explanatory diagram which is used in the description concerning the thickness of the blade (case where thickness of blade is larger than thickness of workpiece).

When a contact region l of the blade is larger than the thickness h of the workpiece, specifically, a relationship of l>h holds, a portion in which the blade comes in contact (portion to be worked and removed) with the workpiece becomes a horizontally long rectangle, as is shown in FIG. 18B. In the case where such a cross-section portion which is an object to be removed becomes the horizontally long rectangle, when a distributed load is applied to the workpiece from the upper part, a state occurs in which the portion is bent into an arch shape by flexure, and the maximum displacement due to the flexure is expressed as follows. (Practically, a plate is bent, but the problem shall be simply considered to be the flexure of a beam, and it is supposed that the distributed load is applied to the beam.)

$$y_{max} = y_{x=1/2} = \frac{5\omega l^4}{384EI} \quad \text{[Expression 8]}$$

In the case of the rectangular beam of which the depth is b and the height is h in the cross section, the following expression holds:

$$I = \frac{bh^3}{12}, \quad \text{[Expression 9]}$$

and accordingly the above expression becomes the following expression.

$$y_{max} = y_{x=1/2} = \frac{5\omega l^4}{32Ebh^3} \quad \text{[Expression 10]}$$

In the middle portion of the beam, the maximum flexure is inversely proportional to the cube of the thickness h of the workpiece, and is proportional to the fourth power of the contact region l of the blade.

In particular, when l/h in a value of $(l/h)^3$ becomes less than 1, while regarding 1 as the boundary, the flexure becomes remarkably small, and on the contrary, when l/h becomes more than 1, the flexure becomes remarkably large. Thereby, the case where the flexure occurs and the case where the flexure does not occur are divided by a relative thickness shape of the thickness (contact region of blade) l of the blade and the thickness h of the workpiece.

When the contact region of the blade is larger than the thickness of the workpiece (l>h), the flexure occurs in the workpiece in the contact region, but when the workpiece is bent, the vibration of the run-out of the workpiece occurs, due to the flexure occurring in the plane intermittently and vertically, and the blade is incapable of attaining the predetermined cut. As a result, the fatal cut is given from the blade into the workpiece due to the vibration in the vertical direction of the workpiece, and thereby cracking occurs in the surface of the workpiece.

Therefore, the machining by the PCD blade of the present application, in particular, needs to stably and faithfully keep a predetermined cut depth, in order to perform a process in a crack-free manner. For the purpose, it is necessary to precisely secure the predetermined cut by suppressing the vertical vibration which occurs when the workpiece itself is worked, in addition to an operation of setting the cut depth by controlling the intervals between the cutting edges.

Figure 18C:
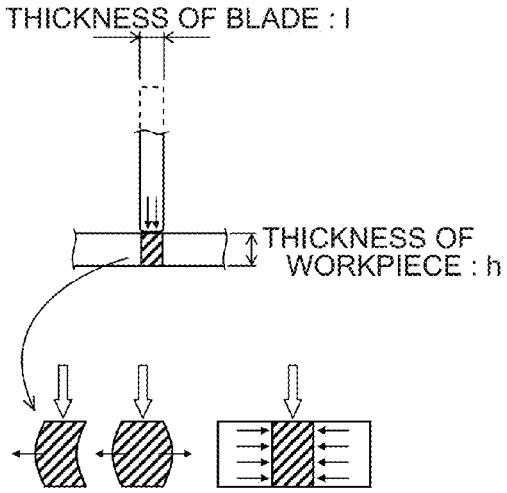
FIG. 18C is an explanatory diagram which is used in the description concerning the thickness of the blade (case where thickness of blade is smaller than thickness of workpiece).

For this purpose, the thickness of the blade must be controlled so as to be thinner than the thickness of the workpiece of an object, as is shown in FIG. 18C.

For instance, when the thickness of the workpiece is 50 μm or less, the width of the blade needs to be naturally set at 50 μm or less.

In this case, it does not occur that the workpiece is bent in the contact region. On the other hand, a stress for curving or compressing the workpiece works in the contact region, but the workpiece is a densely continuous body in the transverse direction, and the deformation of the workpiece is restrained by the Poisson's ratio. Because of this, the workpiece locally reacts with the stress which has been given from the blade as the reaction force from the workpiece, and as a result, the blade is capable of performing the process with the predetermined cut on the workpiece without causing the cracking in the workpiece.

[Comparison with Conventional Blade]

In the case of an electroformed blade described in Patent Literature 1, diamonds are dispersed and are plated from the above. Accordingly, the diamonds exist sparsely, and besides show a structure of projecting. As a result, there is the case where the projecting portion naturally gives an excessive cut, and thereby induces a brittle fracture. For information, a crack resists being formed immediately in a continuous portion in a bottom portion and a side face part of a groove, because the workpiece material is tightly formed with each other, but the crack and breaking occur most easily in a portion from which the blade is extracted. The phenomenon is similar to a phenomenon in which a burr is formed when the blade is extracted, and occurs because the workpiece material is not continuous and does not have a support.

In addition, in the case of the blade of Patent Literature 2, the film is formed by a CVD method, and there is not a projecting crack. However, it is impossible to control the arrangement of the cutting edge in the end of the blade, and a planer state and waviness of the side face part of the blade. As for only the side face part of the blade in particular, the nonuniformity of the film thickness at the time of film formation directly corresponds to the nonuniformity of the thickness of the blade. In addition, the surface itself of the formed film is an untreated surface. Accordingly, the surface comes into full contact with a side face of a material, and may induce frictional heat; and has fine waviness, and the waviness may also break the material into pieces.

In contrast to this, the blade 26 of the present embodiment is integrally formed of the diamond sintered body which is sintered with the use of a sintering aid of soft metal, and accordingly it becomes possible to form the outer peripheral end part of the blade and the side face part of the blade by wearing treatment. The outer peripheral end part of the blade becomes the cutting edge, in particular, and accordingly it is also possible to further change a condition of the wearing treatment so as to form the predetermined cutting edge, as has been described above. On the other hand, the role of the side face part of the blade is firstly to remove swarf. However, when the contact with a side face of the workpiece is also taken into consideration, it is desirable that the side face part of the blade comes into contact with the side face of the workpiece to some extent, but does not excessively come into contact therewith, and is roughened to such a degree that the side face part of the blade stably and finely cuts the side face of the workpiece.

Thus, the technology in any one of the cited literatures cannot achieve a process of designing a desired surface state according to each of the states of the outer peripheral end part of the blade and the side face part of the blade, and manufacturing surfaces of the blade into the surfaces as in the above.

Incidentally, in the case of the blade which is used for a scribing process, the blade is not suitable for the process in the ductile mode, because of the following reason.

Specifically, in the scribing process, the blade itself is not rotated, and accordingly fine cutting edges that are arrayed at an even interval themselves are not needed. In addition, even if there exist the cutting edges, in the case where the cutting edge is not a fine cutting edge formed along the crystal grain boundary of a micron order but is a large cutting edge, the cutting edge gives a crack to the material in the dicing process in which the blade rotates at high speed, and the blade cannot be used at all. In addition, even if the blade having the fine cutting edge formed along the crystal grain boundary is used in the scribing process, the fine cutting edge does not function as a cutting edge which gives the crack for the scribing process.

In addition, in the scribing process, the blade is pressed in the vertical direction. Therefore, the scribing apparatus is configured so as to give a stress to a lower direction perpendicularly to a shaft which passes through the inside of the blade, and to make the blade slide with respect to the shaft. The shaft and the blade are not fixed in service, and accordingly the clearance of the blade with respect to the shaft is low. In addition, the blade itself does not rotate at high speed. Accordingly, it is also unnecessary to provide a reference surface on one side face of the blade.

In addition, even if the blade for the scribing process is manufactured, which has a thin blade tip of 50 μm or less, especially 30 μm or less, the precise straightness with respect to the workpiece cannot be secured, because a thin bearing receives the blade and there is not the reference surface which receives the bearing with a wide face does not exist in one side face of the blade. As a result, the blade having the thin cutting edge is buckled and deformed, and cannot be used.

[Concerning Strength of Blade]

Next, the relationship between the strength (elastic modulus) of the blade material and the strength (elastic modulus) of the workpiece material will be described.

In order that the blade cuts a fixed amount in the workpiece and progressively cuts into the workpiece in the state, the blade material needs to have a larger strength than that of the workpiece material. Suppose the case where the blade material is formed of simply a softer material than the workpiece material, specifically is formed of a material having small Young's modulus, and suppose that it is intended to make an extremely fine tip portion of the blade act on the surface of the workpiece and make the blade progress. However, if the workpiece material is a member having high elastic modulus, the blade cannot finely deform the surface of the workpiece, and the blade itself is buckled and deformed if the blade is made to forcibly deform the surface of the workpiece. Because of this, the process consequently does not progress. Here, a buckling load P of a long column of which both of the ends are supported is given by the following expression.

$$P = \frac{\pi EI}{l^2} \quad \text{[Expression 11]}$$

wherein the reference characters are defined as follows: E: Young's modulus, I: second moment of area, and l: length of long column (corresponding to blade diameter).

Suppose the case where the blade has an elastic modulus lower than the workpiece material, and suppose that the blade progresses the process while suppressing the buckling and deformation. Such a degree of a second moment of area (cross-sectional secondary moment) that the blade is not buckled and deformed becomes necessary, and specifically the blade cannot help increasing the thickness of itself.

However, in the case where the brittle material is worked and the thickness of the blade is thicker than the thickness of the workpiece, in particular, the blade deforms the surface of the workpiece material, and presses and breaking the workpiece material. Therefore, the thickness of the blade must be set so as to be thinner than the thickness of the workpiece.

Then, as a result, the blade material to be used must have higher elastic modulus than the workpiece material.

Such a relation corresponds to a difference between the conventional electroformed blade and the blade 26 of the present embodiment. Specifically, in the electroformed blade, diamond abrasive grains are bonded with the use of the bonding material such as nickel, and the base material becomes a nickel base. The Young's modulus of nickel is 219 GPa, but the Young's modulus of SiC, for instance, is 450 GPa. The Young's modulus of the diamond abrasive grain itself is 970 GPa, which is electrodeposited by nickel, but the grains independently and individually exist in nickel, and as a result, the grains are controlled by the Young's modulus of nickel. Then, because the workpiece material has high elastic modulus, according to the principle, the blade subordinately must increase the thickness to cope with the high elastic modulus. As a result, it is obliged to thicken the thickness of the electroformed blade and enlarge the contact area, which induces a crack and breaking.

In contrast to this, in the case of the blade 26 of the present embodiment, diamonds are bonded to each other, and accordingly the Young's modulus of the diamond sintered body corresponds to 700 to 800 GPa. The value is almost equal to the Young's modulus of the diamond.

Here, in the case where the elastic modulus of the blade 26 is large as compared with the elastic modulus of the workpiece W, when the blade 26 gives the cut to the workpiece W, the blade 26 is not deformed but the surface in the workpiece W side is deformed. It becomes possible to enter the cut into the workpiece in the state in which the workpiece W side is deformed, and to machine and remove the workpiece. Besides the above, the blade 26 is not buckled and deformed in the process. Therefore, even though being very sharp, the blade 26 can progress the process without being buckled.

The Young's modulus of each material is shown in Table 5. As is clear from Table 5, the Young's modulus of the diamond sintered body (PCD) is markedly high even as compared with those of most materials such as sapphire and SiC. Because of this, the blade is enabled to machine the workpiece even though being thinner than the thickness of the workpiece material.

TABLE 5

| Material | Young's modulus [Gpa] | Vickers hardness Hv |
|---|---|---|
| Silicon | 130 | 1050 |
| Quartz | 76.5 | 1100 |
| Sapphire | 335 | 2300 |
| SiC | 450 | 2300 |
| Nickel | 219 | 600 |
| Copper | 129.8 | 369 |
| PCD | 700-800 | 8000-12000 |

Next, the relationship of the hardness between the workpiece material and the blade material will be described. The relationship of the hardness is also similar to the previous elastic modulus.

In the case where the hardness of the blade material is low as compared with the hardness of the workpiece material, for instance, in the case of the electroformed blade, soft copper and nickel support the diamond. The diamond abrasive grain on the surface has extremely high hardness, but the hardness of nickel which supports the diamond abrasive grain under the grain is very low as compared with diamond. Therefore, when a shock is given to the diamond abrasive grain, nickel under the grain absorbs the shock. As a result, in the case of the electroformed blade, the hardness of nickel becomes dominant. Accordingly, as a result, even though the hard diamond abrasive grain intends to collide with the workpiece material and to give the cut to the workpiece, the bonding material absorbs the shock, and accordingly as a result, it becomes difficult to give a predetermined cut to the workpiece. Therefore, in order to progress the process, it is necessary to rotate the blade at a fixed rotation number or more to shockingly give a force to the diamond. Otherwise, the process does not progress. In addition, the shock is absorbed by nickel for a moment at this time, and the reaction force pushes the diamond abrasive grain and presses the workpiece material with a big force, which causes a brittle fracture in the workpiece material.

In contrast to this, in the case of the blade 26 of the present embodiment, the diamond sintered body has the hardness equivalent to a diamond single crystal, and the hardness is markedly high hardness even as compared with that of hard brittle materials such as sapphire and SiC. As a result, even though the cutting edge (fine cutting edge) formed of the recessed part which is formed on the surface of the diamond sintered body acts on the workpiece material, the shock acts locally on the fine cutting edge part in the state, and the blade is enabled to precisely machine and remove an extremely fine portion in cooperation with its a sharp tip portion.

As has been described above, the blade 26 of the present embodiment is integrally formed into a discoid shape by the diamond sintered body 80 which contains 80% or more of the diamond abrasive grains 82, and in the outer circumferential part of the blade 26, a cutting edge part 40 is provided in which cutting edges (fine cutting edge) formed of recessed parts which are formed on the surface of the diamond sintered body are continuously arranged along a circumferential direction. Because of this, the cut amount of the blade 26 for the workpiece is enabled to be controlled with high precision, as compared with the conventional electroformed blade. As a result, the blade makes the cut into the workpiece even formed of the brittle material, in the state in which the cut amount of the blade 26 is set at the critical cut amount of the workpiece or less, and thereby can stably perform cutting process in the ductile mode with high precision, without causing a crack and breaking.

In addition, the recessed part formed on the surface of the diamond sintered body 80 functions as a pocket for transporting the swarf which are produced when the workpiece W is subjected to the process. Thereby, the discharge performance for the swarf are enhanced, and the heat generated during the process can also be discharged together with the swarf. In addition, the diamond sintered body 80 has high thermal conductivity, accordingly the heat generated at the time of the cutting process is not accumulated in the blade 26, and the diamond sintered body 80 shows also an effect of preventing the increase of a cutting resistance and the warpage of the blade 26.

In the above description, the dicing blade according to the present invention has been described in detail, but the present invention is not limited to the above described examples, and of course, can be improved or modified in various ways, in such a range as not to deviate from the scope of the present invention.

REFERENCE SIGNS LIST

10 . . . dicing apparatus, 20 . . . machining unit, 26 . . . blade, 28 . . . spindle, 30 . . . worktable, 36 . . . hub, 38 . . . mounting hole, 40 . . . cutting edge part, 42 . . . diamond abrasive grain, 44 . . . spindle main body, 46 . . . spindle shaft, 48 . . . hub flange, 80 . . . diamond sintered body, 82 . . . diamond abrasive grain, 84 . . . cutting edge (fine cutting edge), 86 . . . sintering aid

The invention claimed is:

1. A dicing blade for rotation driving, the dicing blade configured to be mounted on a rotating spindle and to relatively slide on a flat tabular workpiece formed from a brittle material at a certain cut depth to perform a cutting or grooving process on the workpiece in a ductile mode, wherein:

the dicing blade is formed into a discoid shape and is integrally composed of a polycrystalline diamond, wherein, in the polycrystalline diamond, diamond abrasive grains are combined with each other by sintering, and in order to perform a ductile mode process:

the polycrystalline diamond has a content of the diamond abrasive grains of 80 vol % or more; and diamond abrasive grains on an outer circumference of the dicing blade define a pattern of concavities, each of the concavities defined by a respective single crystal grain boundary between an edge of a respective first single diamond abrasive grain and an edge of a respective second single diamond abrasive crystal grain bonded directly to the respective first single diamond abrasive grain in a circumferential direction of the dicing blade, the plurality of concavities defining a plurality of cutting edges of the dicing blade.

2. The dicing blade according to claim 1, wherein the cut-depth of each of the plurality of cutting edges is a critical cut depth or less, the critical cut depth being a maximum cut depth at which brittle fracture of the workpiece is prevented.

3. The dicing blade according to claim 1, wherein an average particle size of the diamond abrasive grains is 25 μm or less.

4. The dicing blade according to claim 1, wherein a thickness of the outer circumferential part of the dicing blade is 50 μm or less.

5. The dicing blade according to claim 1, wherein a cross-section of a cutting edge part of the dicing blade has a straight shape.

6. The dicing blade according to claim 1, wherein a cross-section of a cutting edge part of the dicing blade has a tapered shape, and the cutting edge part having the tapered shape has a taper angle of 20 degrees or less.

7. The dicing blade according to claim 1, wherein the pattern of concavities includes immediately adjacent concavities being formed at even intervals around the circumference of the dicing blade.

8. The dicing blade according to claim 1, wherein each of the plurality of cutting edges is formed of a plurality of diamond abrasive grains.

9. The dicing blade according to claim 1, wherein each single crystal grain boundary forms a separate cutting edge.

10. The dicing blade according to claim 1, wherein a size of each cutting edge is set according to a size of the diamond abrasive grains and the content of the diamond abrasive grains in the polycrystalline diamond.

11. The dicing blade according to claim 10, wherein the size of each concavity is smaller than a particle size of the diamond abrasive grains.

12. The dicing blade according to claim 2, wherein the critical cut depth is in a range of 0.15 μm and 6.22 μm.

13. The dicing blade according to claim 1, comprising a continuous rim blade defined by the pattern of concavities being formed continuously around the outer circumference of the blade.

* * * * *